US011485596B2

(12) United States Patent
Namiki et al.

(10) Patent No.: US 11,485,596 B2
(45) Date of Patent: Nov. 1, 2022

(54) MEDIUM FEEDING APPARATUS, IMAGE READING APPARATUS, AND MEDIUM FEEDING METHOD IN MEDIUM FEEDING APPARATUS

(71) Applicant: SEIKO EPSON CORPORATION, Tokyo (JP)

(72) Inventors: Masaki Namiki, Shiojiri (JP); Yoichiro Nishimura, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 154 days.

(21) Appl. No.: 17/103,636

(22) Filed: Nov. 24, 2020

(65) Prior Publication Data

US 2021/0155439 A1 May 27, 2021

(30) Foreign Application Priority Data

Nov. 27, 2020 (JP) ..... JP2019-214390

(51) Int. Cl.

| | |
|---|---|
| ***B65H 7/12*** | (2006.01) |
| ***B65H 43/00*** | (2006.01) |
| ***B65H 3/52*** | (2006.01) |
| *B65H 29/12* | (2006.01) |

(52) U.S. Cl.

CPC ..... *B65H 7/125* (2013.01); *B65H 3/5284* (2013.01); *B65H 43/00* (2013.01); *B65H 29/12* (2013.01); *B65H 2403/732* (2013.01); *B65H 2404/1441* (2013.01); *B65H 2405/324* (2013.01); *B65H 2511/214* (2013.01); *B65H 2513/11* (2013.01); *B65H 2553/30* (2013.01); *B65H 2701/1313* (2013.01); *B65H 2801/39* (2013.01)

(58) Field of Classification Search

CPC ..... B65H 2701/1313; B65H 7/125; B65H 3/5284; B65H 43/00; B65H 29/12; B65H 2403/732; B65H 2511/214

USPC ..... 271/10.11, 265.02

See application file for complete search history.

(56) References Cited

U.S. PATENT DOCUMENTS

| | | | | |
|---|---|---|---|---|
| 7,308,853 | B2 * | 12/2007 | Satoh | B65H 5/34 101/118 |
| 7,775,519 | B2 * | 8/2010 | Takahashi | B65H 7/00 271/265.02 |
| 8,444,135 | B2 * | 5/2013 | Morita | B65H 7/14 271/265.01 |

(Continued)

FOREIGN PATENT DOCUMENTS

JP 2018-016484 2/2018

*Primary Examiner* — Jeremy R Severson
(74) *Attorney, Agent, or Firm* — Workman Nydegger

(57) ABSTRACT

A medium feeding apparatus capable of switching between a first feeding mode and a second feeding mode, in which in the first feeding mode, when a first detection section positioned downstream of a feeding roller in a medium feeding direction detects passage of a trailing end of a preceding medium in a feeding standby state in which driving of the feeding roller that feeds the medium is stopped, starting the driving of the feeding roller to perform feeding of a succeeding medium, and in the second feeding mode, when a second detection section positioned downstream of the first detection section in the medium feeding direction detects the passage of the trailing end of the preceding medium in the feeding standby state, starting the driving of the feeding roller to perform the feeding of the succeeding medium.

11 Claims, 16 Drawing Sheets

(56) References Cited

U.S. PATENT DOCUMENTS

2004/0223797 A1* 11/2004 Ueda ..... B65H 7/00
399/388
2018/0032018 A1 2/2018 Takatou

* cited by examiner

FIG. 11

| | | | | ELEMENT (1) | ELEMENT (2) | ELEMENT (3) | ELEMENT (4) | ELEMENT (5) | ELEMENT (6) | ELEMENT (7) |
|---|---|---|---|---|---|---|---|---|---|---|
| APPARATUS MAIN BODY POSTURE | SWITCHING LEVER | UI INSTRUCTION | FEEDING MODE | SEPARATION MOTOR DRIVE FORCE | SEPARATION ROLLER PRESSING FORCE | EACH CURVE FORMING PORTION | SEPARATION MOTOR DRIVE MODE | SEPARATION MOTOR SPEED | FIRST DOCUMENT DETECTION SECTION | MULTI-FEEDING DETECTION SECTION |
| FIRST READING POSTURE (INCLINED) | NORMAL POSITION | — | THIRD | TRANSMIT DRIVE FORCE | STANDARD | SECOND STATE (UP) | CONTINUOUS DRIVING | STANDARD | USED | USED |
| FIRST READING POSTURE (INCLINED) | NON-SEPARATION POSITION | — | FOURTH | CUT DRIVE FORCE | STANDARD | SECOND STATE (UP) | — | STANDARD | USED | USED |
| SECOND READING POSTURE (HORIZONTAL) | SOFT SEPARATION POSITION | STRONG SEPARATION OFF | FIRST | TRANSMIT DRIVE FORCE | WEAK | FIRST STATE (DOWN) | INTERMITTENT DRIVING | LOW | USED | USED |
| SECOND READING POSTURE (HORIZONTAL) | SOFT SEPARATION POSITION | STRONG SEPARATION ON | SECOND | TRANSMIT DRIVE FORCE | WEAK | FIRST STATE (DOWN) | CONTINUOUS DRIVING | STANDARD | NOT USED | NOT USED |

MEDIUM FEEDING APPARATUS, IMAGE READING APPARATUS, AND MEDIUM FEEDING METHOD IN MEDIUM FEEDING APPARATUS

The present application is based on, and claims priority from JP Application Serial Number 2019-214390, filed Nov. 27, 2019, the disclosure of which is hereby incorporated by reference herein in its entirety.

BACKGROUND

1. Technical Field

The present disclosure relates to a medium feeding apparatus that feeds a medium and an image reading apparatus provided with the medium feeding apparatus. The present disclosure also relates to a medium feeding method in the medium feeding apparatus.

2. Related Art

In a printer that is an example of a scanner or a recording apparatus that is an example of an image reading apparatus, as a method of separating a medium, a method may be adopted in which the medium is nipped and separated by a separation roller to which a rotation resistance or a reverse rotation direction torque is applied and a feeding roller that rotates in a medium feeding direction. JP-A-2018-16484 discloses an image scanner provided with a document transporting apparatus that adopts such a separation method.

Some documents have strong adhesion between the documents and are difficult to separate, while others are relatively easy to separate. In the former case, separation by the separation roller may not be performed, and the multi-fed documents proceed downstream of the separation roller. In the related art, although in many cases, when it is determined that multi-feeding of documents is occurring downstream of the separation roller, the feeding of the succeeding document is consistently stopped, there are cases in which the multi-fed documents may be prevented from reaching the reading area by continuously performing separation using the separation roller, and when the document feeding operation is consistently stopped, including such cases that are possible to save, the ease-of-use of the apparatus is impaired.

SUMMARY

According to an aspect of the present disclosure, there is provided a medium feeding apparatus including a medium placement section on which a medium is placed before feeding, a feeding roller that feeds the medium placed on the medium placement section, a separation roller that nips the medium with the feeding roller to promote separation of the medium, a transport roller that is positioned downstream in a medium feeding direction with respect to a medium nipping position between the feeding roller and the separation roller and that transports the medium downstream in the medium feeding direction, a first detection section that is positioned upstream of the transport roller and downstream of the medium nipping position formed between the feeding roller and the separation roller in the medium feeding direction and that detects passage of the medium, a second detection section that is positioned downstream of the transport roller in the medium feeding direction and that detects the passage of the medium, and a control section that controls the feeding of the medium based on detection information of the first detection section and the second detection section, in which the control section includes a first feeding mode in which when the first detection section detects the passage of a trailing end of a preceding medium in a feeding standby state in which driving of the feeding roller is stopped, the control section starts the driving of the feeding roller to perform feeding of a succeeding medium, and when the second detection section detects the trailing end of the preceding medium before the first detection section detects the trailing end of the preceding medium, the control section stops the feeding of the succeeding medium, and a second feeding mode which is a feeding mode that does not use the first detection section and in which when the second detection section detects the passage of the trailing end of the preceding medium in the feeding standby state, the control section starts the driving of the feeding roller to perform the feeding of the succeeding medium.

BRIEF DESCRIPTION OF THE DRAWINGS

FIG. 11 is a diagram illustrating the contents of each feeding mode.

DESCRIPTION OF EXEMPLARY EMBODIMENTS

Figure 1:
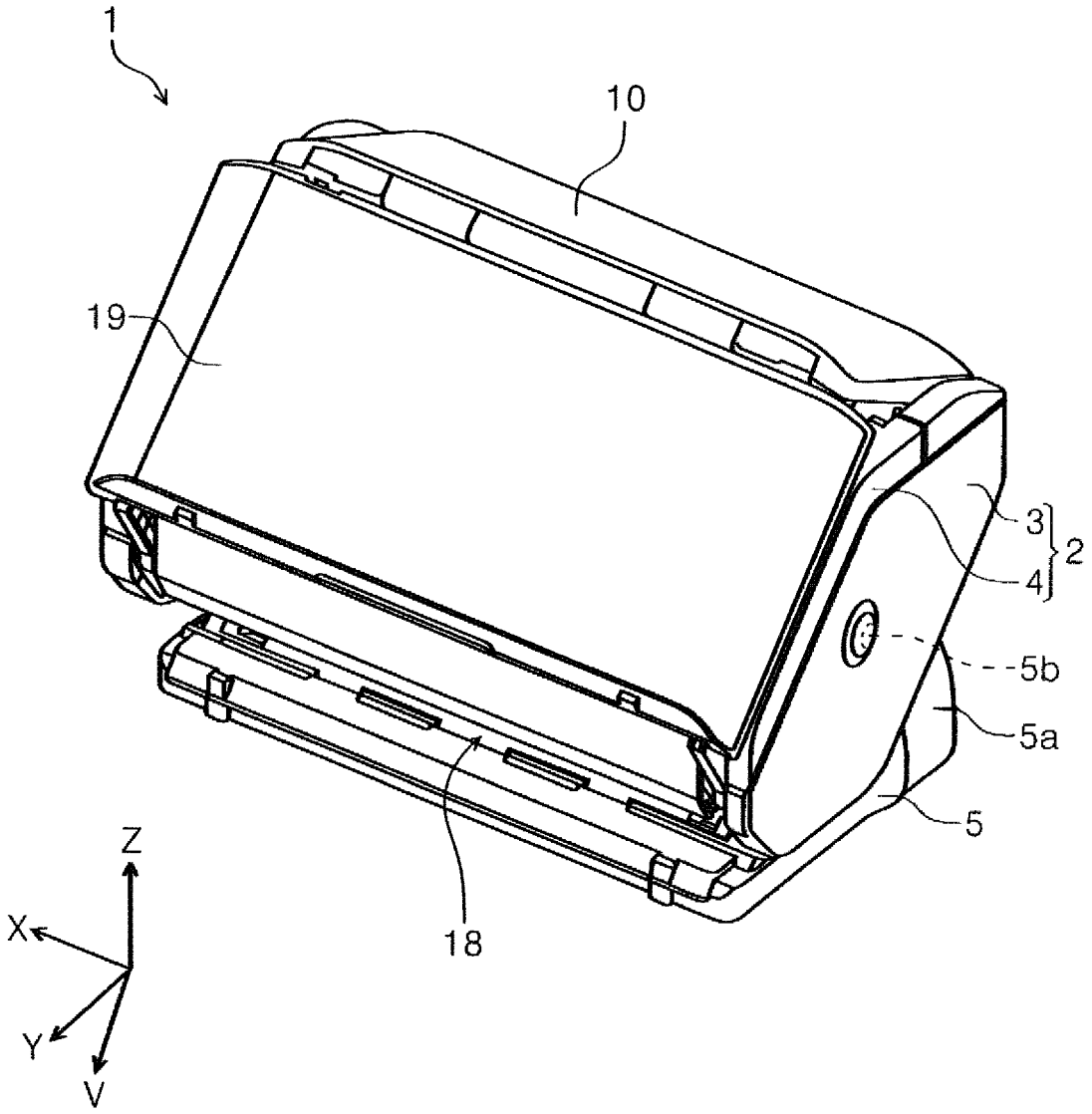
FIG. 1 is an external perspective view of a scanner in a state in which an apparatus main body in a second posture as viewed from the front.

An overview of the present disclosure will be described below.

A medium feeding apparatus according to a first aspect of the present disclosure includes a medium placement section on which a medium is placed before feeding, a feeding roller that feeds the medium placed on the medium placement section, a separation roller that nips the medium with the feeding roller to promote separation of the medium, a transport roller that is positioned downstream in a medium feeding direction with respect to a medium nipping position between the feeding roller and the separation roller and that transports the medium downstream in the medium feeding direction, a first detection section that is positioned upstream of the transport roller and downstream of the medium nipping position formed between the feeding roller and the separation roller in the medium feeding direction and that detects passage of the medium, a second detection section that is positioned downstream of the transport roller in the medium feeding direction and that detects the passage of the medium, and a control section that controls the feeding of the medium based on detection information of the first detection section and the second detection section, in which the control section includes a first feeding mode in which when the first detection section detects the passage of a trailing end of a preceding medium in a feeding standby state in which driving of the feeding roller is stopped, the control section starts the driving of the feeding roller to perform feeding of a succeeding medium, and when the second detection section detects the trailing end of the preceding medium before the first detection section detects the trailing end of the preceding medium, the control section stops the feeding of the succeeding medium, and a second feeding mode which is a feeding mode that does not use the first detection section and in which when the second detection section detects the passage of the trailing end of the preceding medium in the feeding standby state, the control section starts the driving of the feeding roller to perform the feeding of the succeeding medium.

According to this aspect, in the second feeding mode, when the second detection section downstream of the first detection section detects the passage of the trailing end of the preceding medium, the control section starts the driving of the feeding roller to perform the feeding of the succeeding medium, and so it is possible to lengthen the stopping period of the feeding roller, that is, the separation period of the separation roller in the second feeding mode as compared with the first feeding mode, and the separation of the preceding medium and the succeeding medium may be anticipated even if a multi-feeding state arises in which the leading end of the succeeding medium exceeds the separation roller and further approaches the first detection section. Therefore, it is possible to improve the usability of the apparatus as compared with a case in which the multi-feeding is determined based on the detection information of the first detection section and the feeding of the succeeding medium is stopped.

In the first feeding mode, when the first detection section upstream of the second detection section detects the passage of the trailing end of the preceding medium, the driving of the feeding roller is started to perform the feeding of the succeeding medium, and so it is possible to narrow the interval between the preceding medium and the succeeding medium as compared with in the second feeding mode, and it is possible to improve the throughput.

As described above, when the user places an emphasis on separation performance, it is possible to perform the feeding even with a medium that does not separate easily by selecting the second feeding mode, and when the user places an emphasis on throughput, it is possible to suppress a reduction in the throughput by selecting the first feeding mode, and so it is possible to realize an apparatus with good usability.

According to a second aspect, in the first aspect, the medium feeding apparatus may further include a multi-feeding detection section capable of detecting multi-feeding of a medium and provided upstream of the transport roller and downstream of the first detection section in the medium feeding direction, in which the control section uses the multi-feeding detection section in the first feeding mode and does not use the multi-feeding detection section in the second feeding mode.

According to this aspect, since the control section uses the multi-feeding detection section in the first feeding mode and does not use the multi-feeding detection section in the second feeding mode, it is possible to continuously perform the separation using the separation roller in the second feeding mode even when the multi-feeding state arises, and the separation of the preceding medium and the succeeding medium may be anticipated.

According to a third aspect, in the first or second aspect, the medium feeding apparatus further includes a separation roller drive motor that applies a drive torque to the separation roller in a first rotation direction in which the separation roller feeds the medium downstream and a second rotation direction which is the reverse of the first rotation direction, and a torque limiter which idles the separation roller in the first rotation direction regardless of the drive torque when the rotational torque applied to the separation roller in the first rotation direction exceeds a predetermined torque upper limit value, in which the control section applies the drive torque to the separation roller in the second rotation direction in the first feeding mode and the second feeding mode, and renders a rotation speed of the separation roller drive motor in the second feeding mode faster than the rotation speed of the separation roller drive motor in the first feeding mode.

According to this aspect, since the control section sets the rotation speed of the separation roller drive motor in the second feeding mode to be higher than the rotation speed of the separation roller drive motor in the first feeding mode, it is possible to improve the separation performance in the second feeding mode as compared with the first feeding mode.

In the first feeding mode, since the rotation speed of the separation roller drive motor is lower than that in the second feeding mode, it is possible to suppress damage to the leading end of the medium by the separation roller.

According to a fourth aspect, in the first or second aspect, the medium feeding apparatus further includes a separation roller drive motor that applies a drive torque to the separation roller in a first rotation direction in which the separation roller feeds the medium downstream and a second rotation direction which is the reverse of the first rotation direction, and a torque limiter which idles the separation roller in the first rotation direction regardless of the drive torque when the rotational torque from the feeding roller applied to the separation roller in the first rotation direction exceeds a predetermined torque upper limit value, in which the control section intermittently applies the drive torque to the separation roller in the second rotation direction in the first feeding mode, and continuously applies the drive torque to the separation roller in the second rotation direction in the second feeding mode.

According to this aspect, in the first feeding mode, the control section intermittently applies the drive torque to the separation roller in the second rotation direction, and in the second feeding mode, continuously applies the drive torque to the separation roller in the second rotation direction, and so it is possible to improve the separation performance in the second feeding mode as compared with the first feeding mode.

In the first feeding mode, since the drive torque is intermittently applied to the separation roller in the second rotation direction, it is possible to suppress damage to the leading end of the medium by the separation roller.

According to a fifth aspect, in the first or second aspect, the medium feeding apparatus further includes a separation roller drive motor that applies a drive torque to the separation roller in a first rotation direction in which the separation roller feeds the medium downstream and a second rotation direction which is the reverse of the first rotation direction, and a torque limiter which idles the separation roller in the first rotation direction regardless of the drive torque when the rotational torque applied to the separation roller in the first rotation direction from the feeding roller exceeds a predetermined torque upper limit value, in which the control section provides a period in which application of the drive torque in the first rotation direction and application of the drive torque in the second rotation direction are alternately performed on the separation roller in the second feeding mode.

According to this aspect, since the control section provides a period in which application of drive torque in the first rotation direction and application of drive torque in the second rotation direction are alternately performed on the separation roller in the second feeding mode, it is possible to generate a sliding action between the preceding medium and the succeeding medium in the upstream direction and the downstream direction of the medium feeding direction, and it is possible to promote the elimination of the adherence between the preceding medium and the succeeding medium.

According to a sixth aspect, in the first or second aspect, the medium feeding apparatus further includes a support member capable of switching between a first state in which the support member causes the medium to not contact the feeding roller by supporting the medium and a second state in which the support member causes the medium to contact the feeding roller and provided upstream of the medium nipping position between the feeding roller and the separation roller in the medium feeding direction, in which the control section provides a period in which switching from the second state to the first state of the support member and switching from the first state to the second state of the support member are alternately performed before starting the driving of the feeding roller from the feeding standby state in the second feeding mode.

According to this aspect, the control section provides a period in which switching from the second state to the first state of the support member and switching from the first state to the second state of the support member are alternately performed in the second feeding mode before starting the driving of the feeding roller from the feeding standby state, and so it is possible to apply a vibration to the medium and it is possible to promote the elimination of the adherence between the preceding medium and the succeeding medium.

An image reading apparatus according to a seventh aspect includes a reading unit that reads a surface of a medium and the medium feeding apparatus according to any one of the first to sixth aspects.

According to this aspect, the operation of any one of the first to sixth aspects may be obtained in the image reading apparatus.

According to an eighth aspect, in the seventh aspect, the image reading apparatus further includes an apparatus main body portion including the reading unit, a support portion that supports the apparatus main body portion such that the apparatus main body portion is changeable in posture, in which the apparatus main body portion is capable of switching between a first reading posture in which the medium feeding direction is directed to an obliquely downward direction, and a second reading posture in which the medium feeding direction is a horizontal direction or is a direction closer to the horizontal direction than in the first reading posture, and includes a posture detection section that detects the posture of the apparatus main body portion, and an operation section that displays various information and receives various operations, and when the apparatus main body portion switches from the first reading posture to the second reading posture, the control section deploys a user interface with which it is possible to select the second feeding mode on the operation section.

According to this aspect, since it is possible to select the second feeding mode by switching to the second reading posture in which the medium feeding direction is a horizontal direction or is a direction closer to the horizontal direction than in the first reading posture, it is possible to still further suppress the multi-feeding of the medium.

According to a ninth aspect, in the eighth aspect, the image reading apparatus further includes a position detection unit configured to switch between a first pressing force and a second pressing force smaller than the first pressing force with regard to a pressing force when the separation roller is pressed against the feeding roller by operating a switching lever provided on the apparatus main body portion and to detect a position of the switching lever, in which only in a state in which the pressing force is the second pressing force in a state in which the apparatus main body portion is switched from the first reading posture to the second reading posture, the control section deploys the user interface with which it is possible to select the second feeding mode on the operation section.

According to this aspect, since the second feeding mode is selectable only in a state in which the pressing force when the separation roller is pressed against the feeding roller is the second pressing force smaller than the first pressing force, it is possible to still further suppress the multi-feeding of the medium.

According to a tenth aspect, a medium feeding method in a medium feeding apparatus configured to switch between a first feeding mode and a second feeding mode, including in the first feeding mode, when a first detection section positioned downstream of a feeding roller in a medium feeding direction detects passage of a trailing end of a preceding medium in a feeding standby state in which driving of the feeding roller that feeds the medium is stopped, starting the driving of the feeding roller to perform feeding of a succeeding medium, and in the second feeding mode, when a second detection section positioned downstream of the first detection section in the medium feeding direction detects the passage of the trailing end of the preceding medium in the feeding standby state, starting the driving of the feeding roller to perform the feeding of the succeeding medium.

According to this aspect, in the second feeding mode, when the second detection section downstream of the first detection section detects the passage of the trailing end of the preceding medium, the control section starts the driving of the feeding roller to perform the feeding of the succeeding medium, and so it is possible to lengthen the stopping period of the feeding roller, that is, the separation period of the separation roller in the second feeding mode as compared with the first feeding mode, and the separation of the preceding medium and the succeeding medium may be anticipated even if a multi-feeding state arises in which the leading end of the succeeding medium exceeds the separation roller and further approaches the first detection section. Therefore, it is possible to improve the usability of the apparatus as compared with a case in which the multi-feeding is determined based on the detection information of the first detection section and the feeding of the succeeding medium is stopped.

In the first feeding mode, when the first detection section upstream of the second detection section detects the passage of the trailing end of the preceding medium, the driving of the feeding roller is started to perform the feeding of the succeeding medium, and so it is possible to narrow the interval between the preceding medium and the succeeding medium as compared with in the second feeding mode, and it is possible to improve the throughput.

As described above, when the user places an emphasis on separation performance, it is possible to perform the feeding even with a medium that does not separate easily by selecting the second feeding mode, and when the user places an emphasis on throughput, it is possible to suppress a reduction in the throughput by selecting the first feeding mode, and so it is possible to realize an apparatus with good usability.

Hereinafter, the present disclosure will be specifically described.

Hereinafter, as an example of the image reading apparatus, a description will be given of a scanner 1 that capable of reading at least one of the front surface and the back surface of a document, which is an example of a medium. The scanner 1 is a so-called document scanner that performs reading while causing a document to move with respect to a reading unit.

In an X-Y-Z coordinate system illustrated in each drawing, the X-axis direction is an apparatus width direction and is a document width direction. The Y-axis direction is the apparatus depth direction and is a direction along the horizontal direction. The Z-axis direction is a direction along the vertical direction. A V-axis direction is a document feeding direction and is a direction parallel to a document transport path T described later, and the angles formed by the V-axis direction with respect to the Y-axis direction and the Z-axis direction change depending on the posture of the apparatus.

In the present embodiment, the +Y direction is a direction from the back toward the front of the apparatus, and the −Y direction is the direction from the front toward the back of the apparatus. The left is the +X direction and the right is the −X direction when viewed from the front of the apparatus.

Hereinafter, the direction in which the document is transported (the +V direction) may be referred to as "downstream" and the opposite direction (the −V direction) may be referred to as "upstream".

In FIGS. 1 to 4, the scanner 1 is provided with an apparatus main body portion 2 and a support base 5 that rotatably supports the apparatus main body portion 2.

The apparatus main body portion 2 is configured to include a lower unit 3 and an upper unit 4.

The upper unit 4 is provided to be openable and closable by rotating around a rotary shaft 530 (refer to FIG. 4) with respect to the lower unit 3 and it is possible to expose the document transport path T (described later) by opening the upper unit 4 in front of the apparatus.

The lower unit 3 configuring the apparatus main body portion 2 is rotatably provided on an arm portion 5*a* configuring the support base 5 via a rotary shaft 5*b* and is configured to change posture by rotating.

Figure 4:
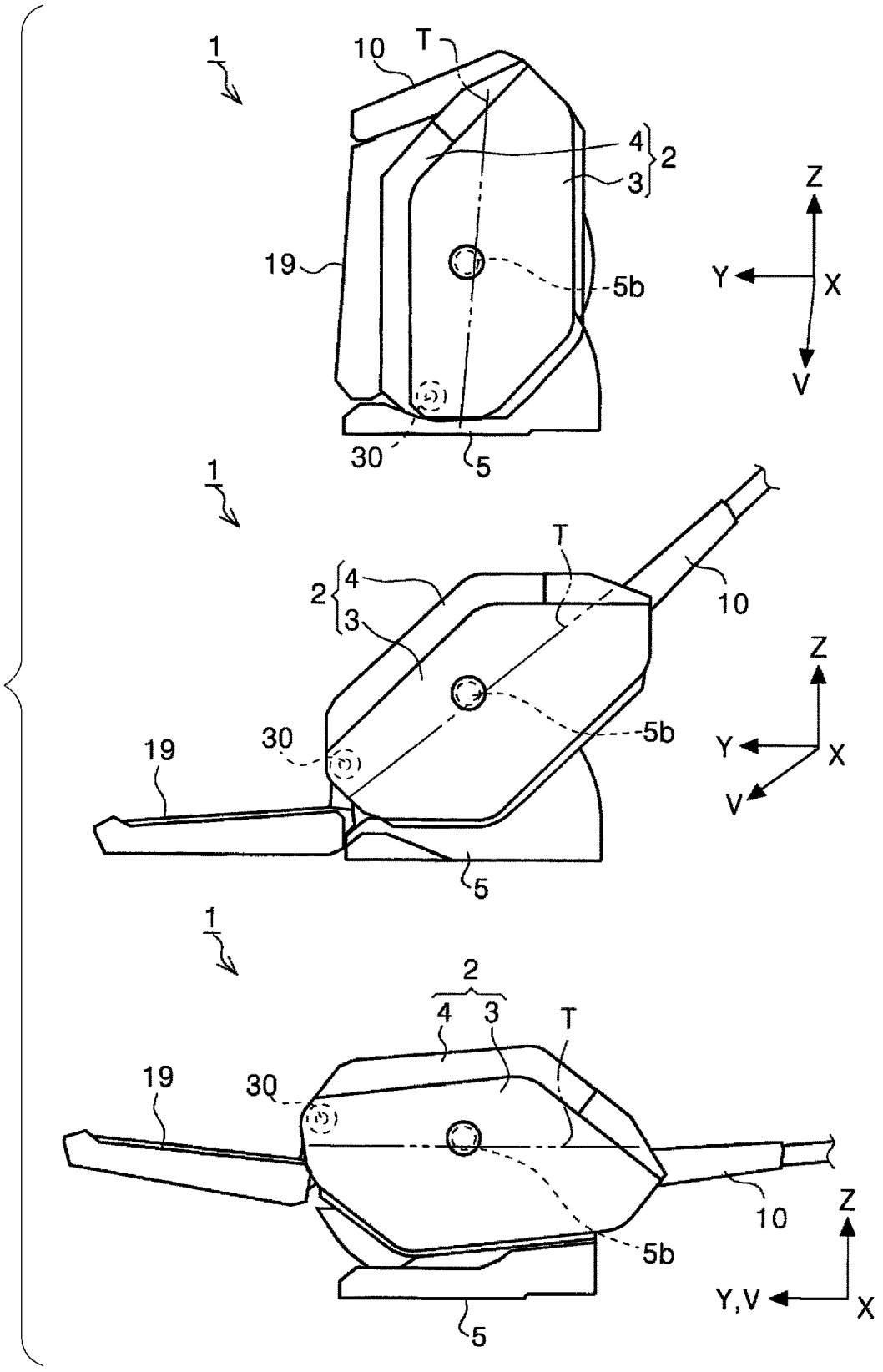
FIG. 4 is a diagram illustrating variations in the posture of the apparatus main body.

The apparatus main body portion 2 of the scanner 1 according to the present embodiment is configured to be capable of changing posture and to be capable of holding three postures using a posture holding unit (not illustrated). Of the three postures, two are postures during the document reading and the remaining one is a non-use posture. The postures illustrated in the center and the bottom parts of FIG. 4 are examples of the postures during the document reading. The center diagram of FIG. 4 is a first reading posture and the bottom diagram of FIG. 4 is a second reading posture. The top diagram of FIG. 4 the non-use posture. In the non-use posture, the projected area of the scanner 1 onto the mounting surface is the smallest, and more specifically, the occupied space in the Y-axis direction is the smallest. In the first reading posture, the projected area is larger than that in the non-use posture, and in the second reading posture, the projected area is larger than that in the first reading posture. In the first reading posture, the +V direction, which is the document feeding direction, is oriented obliquely downward, and in the second reading posture, the +V direction is a substantially horizontal direction. In the present embodiment, although the +V direction is a substantially horizontal direction in the second reading posture, the posture is not necessarily limited to the horizontal direction and the +V direction may be closer to the horizontal direction than in the first reading posture.

It is possible to hold each posture of the apparatus main body portion 2 using the holding unit (not illustrated), and the postures are configured such that it is possible to release the posture holding state using a release lever (not illustrated). Each of the postures of the apparatus main body portion 2 is configured to be detectable by a posture detection section 49 (refer to FIG. 5). The posture detection section 49 may be a contact sensor or a non-contact sensor. In the case of the non-contact sensor, the posture detection section 49 may be configured by a rotary scale and a rotary encoder. The rotary scale is provided on the apparatus main body portion 2 and the rotary encoder is provided on the support base 5 and includes a light emitting section that emits light to the rotary scale and a light receiving section that receives the transmitted light from the rotary scale.

Figure 2:
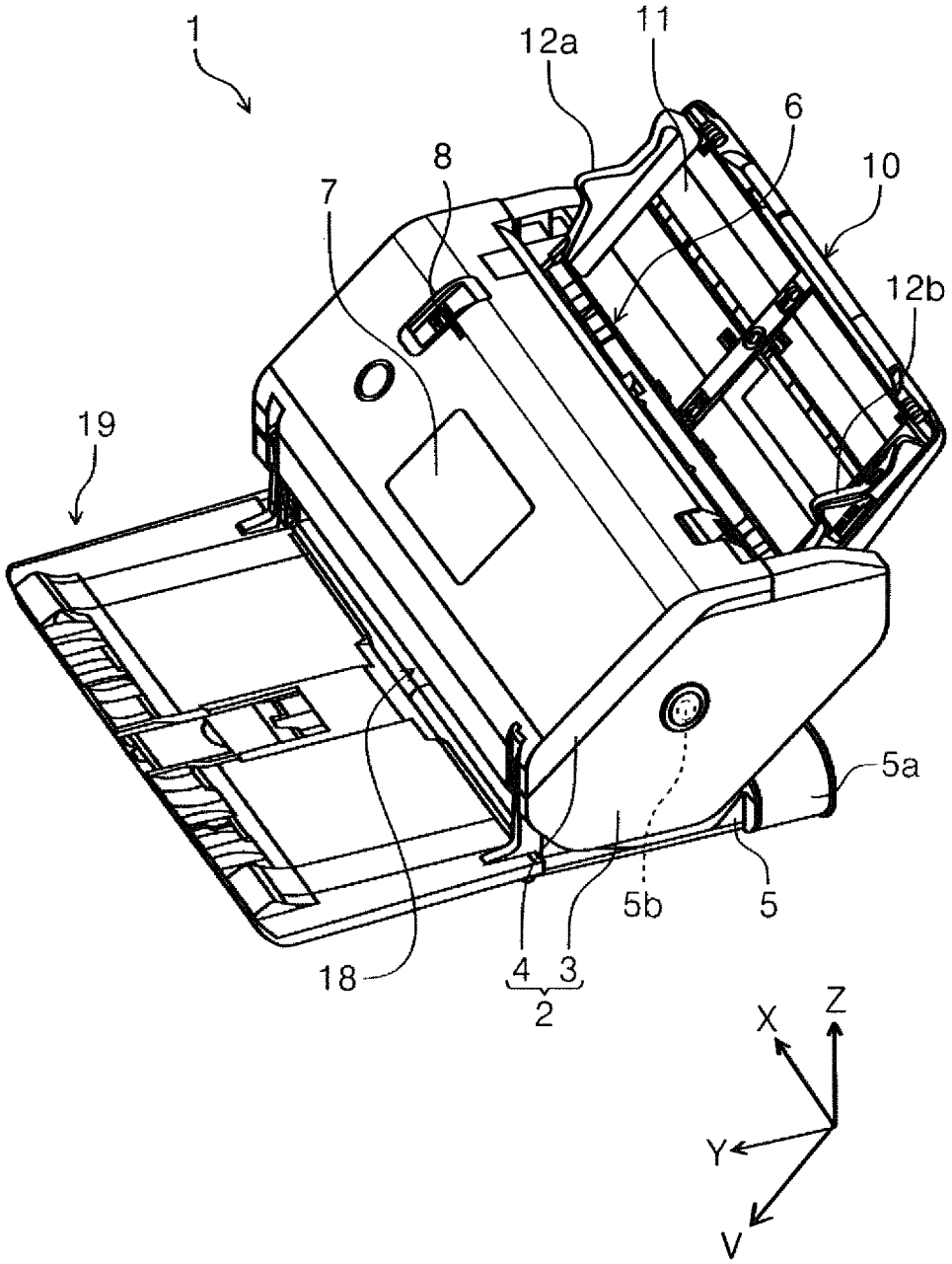
FIG. 2 is an external perspective view of the scanner in a state in which the apparatus main body is in a second posture and a front cover is open, as viewed from the front.

The upper unit 4 is provided with a front cover 19 and the lower unit 3 is provided with a top cover 10. The front cover 19 is provided to be capable of rotating around a rotary shaft 30 with respect to the lower unit 3 and the upper unit 4, and by rotating, the front cover 19 is capable of assuming a closed state as illustrated in FIG. 1 and an open state as illustrated in FIG. 2. When the front cover 19 is opened, the front cover 19 functions as a discharge tray that receives documents that are subjected to reading and discharged.

The upper unit 4 is provided with an operation panel 7 on the upper surface for performing operations such as various reading settings and reading execution as illustrated in FIG. 2 and realizing a user interface for indicating the contents of the reading settings. The operation panel 7 serving as an operation section is a so-called touch panel capable of performing both display and input in the present embodiment and serves as both an operation section for performing various operations and a display section for displaying various information. The operation panel 7 is exposed by opening the front cover 19.

As illustrated in FIG. 2, the upper unit 4 is provided with a switching lever 8 for switching the separation condition during the document feeding. The switching lever 8 is capable of switching between a "normal position" which is a neutral position, a "soft separation position" which is tilted from the normal position toward the front side, that is, the +Y direction, and a "non-separation position" which is tilted from the normal position toward the apparatus depth direction, that is, the −Y direction.

The apparatus main body portion 2 is provided with a lever detection section 48 (refer to FIG. 5) serving as a position detection unit for detecting the position of the switching lever 8, and a control section 50 (refer to FIG. 5) is capable of detecting the current position of the switching lever 8 based on the detection signal of the lever detection section 48.

The difference in separation conditions between each of the positions of the switching lever 8 will be described later.

Figure 3:
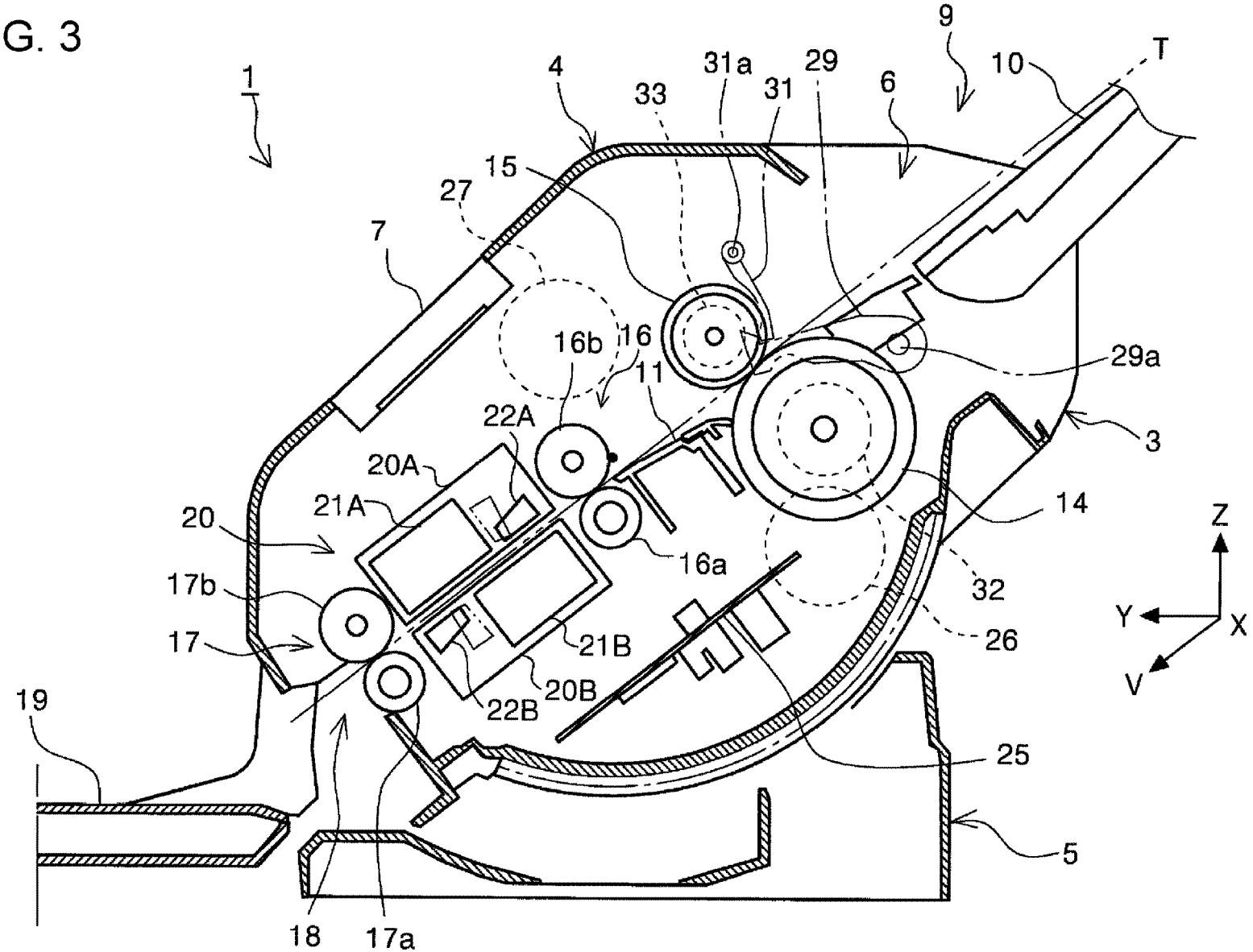
FIG. 3 is a sectional diagram of a document transport path of the scanner in a state in which the apparatus main body is in the second posture, as viewed from a width direction.

The top cover 10 serving as the medium support portion provided on the lower unit 3 is provided to be capable of rotating with respect to the lower unit 3, and by rotating, the top cover 10 is capable of assuming a closed state as illustrated in FIG. 1 and an open state as illustrated in FIGS. 2 and 3. By being opened, the top cover 10 functions as a document support tray that supports a document to be fed. In FIG. 2, reference numerals 12*a* and 12*b* are edge guides that guide the side edges of the document.

A feed port 6 connected to the inside of the apparatus main body portion 2 is provided on the top portion of the apparatus main body portion 2, and a document placed on the top cover 10 is fed from the feed port 6 toward the inside of the apparatus main body portion 2.

Next, the document transport path in the scanner 1 will be described with reference mainly to FIG. 3.

The document transport path T is a substantially linear document transport path formed between the lower unit 3 and the upper unit 4.

The document transport path T becomes the most vertical when the apparatus main body portion 2 is in the non-use posture (the top diagram of FIG. 4), the document transport path T assumes an inclined angle close to 45° when the apparatus main body portion 2 is in the first reading posture (the center diagram of FIG. 4), and the document transport path T is substantially horizontal when the apparatus main body portion 2 is in the second reading posture (the bottom diagram of FIG. 4).

The top cover 10 described above is provided most upstream of the document transport path T, and a feeding roller 14 and a separation roller 15 are provided downstream of the top cover 10. The feeding roller 14 feeds the document placed on the top cover 10 in the downstream direction and the separation roller 15 nips and separates the document between the separation roller 15 and the feeding roller 14. The separation roller 15 is pressed toward the feeding roller 14 by a spring (not illustrated).

The feeding roller 14 contacts the lowest one of the documents placed on the top cover 10. Therefore, when a plurality of documents is placed on the top cover 10, the lowermost documents are sequentially fed in the downstream direction.

The member indicated by reference numeral 31 is a flap, and the flap 31 is positioned further upstream of a first curve forming portion 45, the second curve forming portion 43A, and the third curve forming portion 43B (refer to FIG. 6) described later and prevents the document set on the top cover 10 from contacting the separation roller 15 in the feeding standby state. The flap 31 is capable of rotating around the rotary shaft 31*a* and the bottom end portion of the flap 31 engages with a set guide 29 serving as a "support member" before the feeding is started, so that the flap 31 is prevented from rotating in the clockwise direction in FIG. 3. Before the feeding is started, the set guide 29 assumes a first state in which the document is not allowed to contact the feeding roller 14 by supporting the document.

When the feeding of the document is started, a second state is assumed in which the set guide 29 is caused to rotate in the counterclockwise direction in FIG. 3 around a rotary shaft 29*a* by the power of a transport motor 58 (refer to FIG. 5) and the document is caused to contact the feeding roller 14. When the set guide 29 is switched from the first state to the second state, the flap 31 becomes rotatable, and the leading end of the document stack placed on the top cover 10 abuts against the separation roller 15.

Torque in the counterclockwise direction in FIG. 3, that is, in the direction in which the document is rotated downstream in the feeding direction is transmitted to the feeding roller 14 via a one-way clutch 32 from a feeding motor 57. Hereinafter, the rotation direction of the feeding roller 14 when the feeding roller 14 feeds the document downstream is referred to as a forward rotation direction and the opposite rotation direction is referred to as a reverse rotation direction. Similarly, regarding the rotation direction of the feeding motor 57, the rotation direction when the document is fed downstream is referred to as the forward rotation direction and the opposite direction is referred to as the reverse rotation direction.

Since the one-way clutch 32 is provided in the drive force transmission path between the feeding roller 14 and the feeding motor 57, the feeding roller 14 does not rotate in the reverse direction even if the feeding motor 57 rotates in the reverse direction. In a state in which the feeding motor 57 is stopped, the feeding roller 14 is in contact with the transported document and may be driven and rotated in the forward rotation direction.

Subsequently, the rotational torque is transmitted to the separation roller 15 from a separation motor 59 serving as the "separation roller drive motor" via a torque limiter 33. From the separation motor 59, a torque in the first rotation direction (the clockwise direction in FIG. 3) for feeding the document downstream or a torque in the second rotation direction for returning the document upstream (the counterclockwise direction in FIG. 3 is transmitted to the separation roller 15. Hereinafter, with respect to the rotation direction of the separation roller 15, the first rotation direction may be referred to as the forward rotation direction, and the second rotation direction may be referred to as the reverse rotation direction.

When the document is not present between the feeding roller 14 and the separation roller 15 or when only one sheet is present, the rotational torque for the feeding roller 14 to rotate the separation roller 15 in the forward rotation direction exceeds a torque upper limit value of the torque limiter 33, causing slipping to occur in the torque limiter 33, and so the separation roller 15 is driven to rotate in the forward rotation direction, that is, the separation roller 15 idles regardless of the rotational torque received from the separation motor 59.

During the document feeding operation, the separation motor 59 basically rotates in the reverse direction, that is, the drive torque that causes the separation roller 15 to rotate in the reverse direction is generated.

Next, when second and potentially succeeding documents enter in addition to the document to be fed between the feeding roller 14 and the separation roller 15, slipping occurs between the documents, so that the separation roller 15 is caused to rotate in reverse by the drive torque received from the separation motor 59. Accordingly, the second and potentially succeeding documents that are about to be multi-fed are returned upstream, that is, the multi-feeding is prevented.

The top cover 10 described above is an example of a medium placement section onto which the medium represented by the document is placed. The top cover 10, the feeding roller 14, and the separation roller 15 configure a document feeding apparatus 9 that feeds the document that is an example of the medium. From a different perspective, the document feeding apparatus 9 may also be regarded as an apparatus in which a function (a reading section 20 described later) related to document reading is omitted from the scanner 1. Alternatively, the scanner 1 itself may be regarded as a document feeding apparatus even the scanner 1 is provided with the function related to document reading (the reading section 20 described later), if focusing on the perspective of document feeding.

Next, a transport roller pair 16, the reading section 20 serving as a reading unit that reads a document image, and a discharge roller pair 17 are provided downstream of the feeding roller 14. The transport roller pair 16 is provided with a transport drive roller 16*a* serving as a "transport roller" that is rotationally driven by a motor (not illustrated), and a transport driven roller 16*b* that is driven to rotate.

The document nipped by the feeding roller 14 and the separation roller 15 and fed downstream is nipped by the transport roller pair 16 and is transported to a position facing an upper sensor unit 20A and a lower sensor unit 20B positioned downstream of the transport roller pair 16.

The reading section 20 is provided with the upper sensor unit 20A positioned above the document transport path T and provided in the upper unit 4, and the lower sensor unit 20B provided in the lower unit 3. The upper sensor unit 20A includes a sensor module 21A, and the lower sensor unit 20B includes a sensor module 21B. In the present embodiment, the sensor modules 21A and 21B are contact image sensor modules (CISM).

The sensor module 21A positioned above the document transport path T reads the top surface of the document and the sensor module 21B located below the document transport path T reads the bottom surface of the document.

The document reading surface (not illustrated) of the upper sensor unit 20A and the document reading surface (not illustrated) of the lower sensor unit 20B are parallel to the document transport path T.

The upper sensor unit 20A is provided with a background plate 22A at a position facing the sensor module 21B included in the lower sensor unit 20B, and the lower sensor unit 20B is provided with a background plate 22B at a position facing the sensor module 21A included in the upper sensor unit 20A.

The background plates 22A and 22B are reference plates read by the sensor modules facing the background plates 22A and 22B for shading correction, and it is possible to use, for example, a resin plate of white, gray, black or the like or a metal plate coated in white, gray, black or the like.

The background plates 22A and 22B are provided to be capable of rotating by the power of a motor (not illustrated), and by rotating, are capable of switching between a face-to-face state mutually facing the sensor modules as illustrated by solid lines, and a non-face-to-face state in which the face-to-face state is eliminated as illustrated by double-dot dashed lines. The background plates 22A and 22B are, for example, white, and it is possible to obtain a white reference value in the face-to-face state, and it is possible to obtain a black reference value in the non-face-to-face state.

After the image of at least one of the top surface and the bottom surface of the document is read by the reading section 20, the document is nipped by the discharge roller pair 17 positioned downstream of the reading section 20 and is discharged from a discharge port 18.

The discharge roller pair 17 is configured to include a discharge drive roller 17*a* that is rotationally driven by a motor (not illustrated) and a discharge driven roller 17*b* that is driven to rotate.

Figure 5:
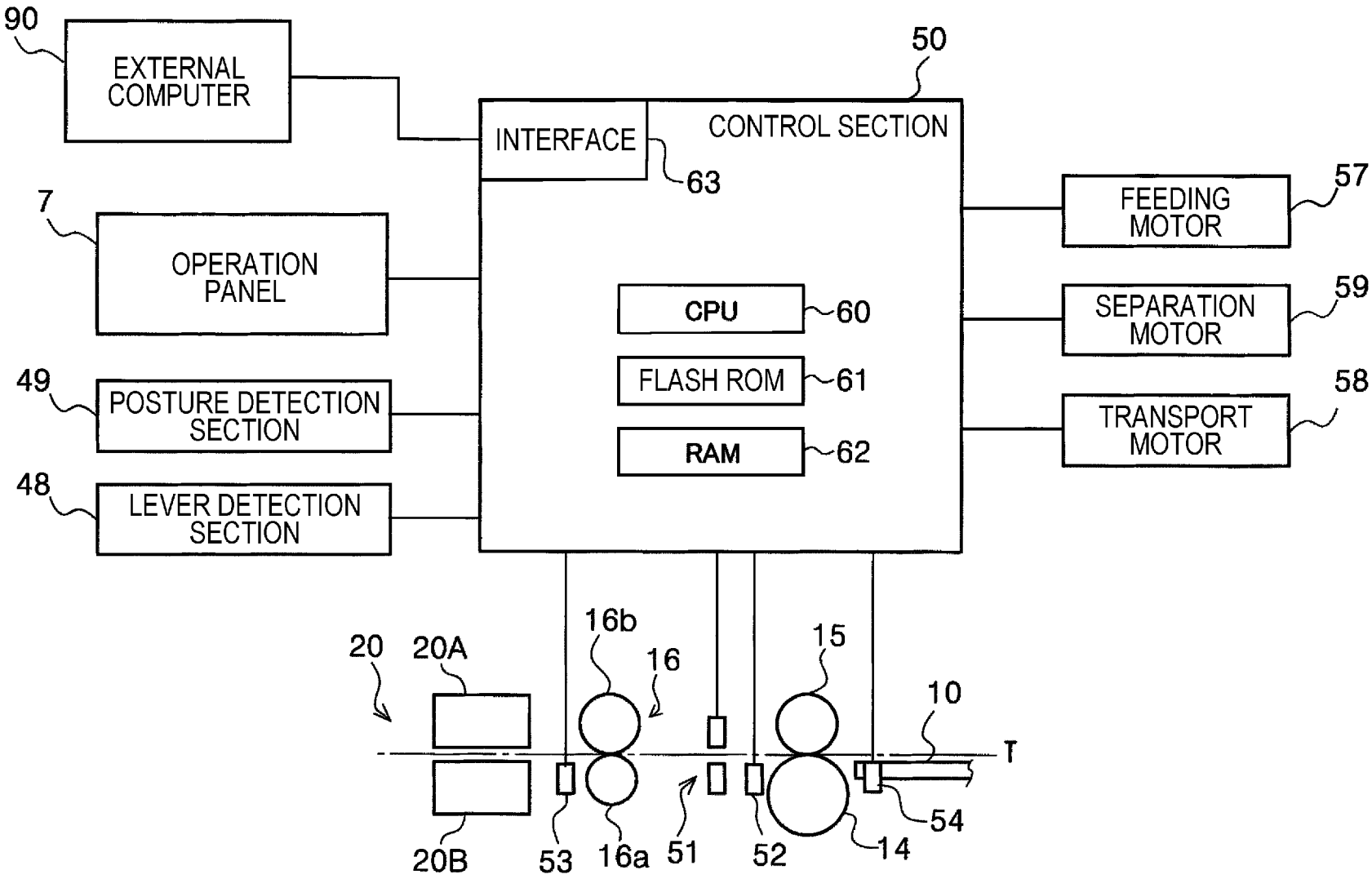
FIG. 5 is a block diagram illustrating a control system of the scanner.

Subsequently, a control system in the scanner 1 will be described with reference to FIG. 5.

The control section 50 performs various control of the scanner 1 including feeding, transporting, discharging control and reading control of the document. A signal from the operation panel 7 is input to the control section 50, and a signal for realizing the display of the operation panel 7, particularly a user interface (UI) is transmitted from the control section 50 to the operation panel 7.

The control section 50 controls the feeding motor 57, the transport motor 58, and the separation motor 59. In the present embodiment, each motor is a DC motor.

The read data from the reading section 20 is input to the control section 50, and a signal for controlling the reading section 20 is transmitted from the control section 50 to the reading section 20.

The control section 50 also receives input of signals from a placement detection section 54, a multi-feeding detection section 51, a first document detection section 52, a second document detection section 53, the posture detection section 49, and the lever detection section 48.

The detection values of rotary encoders (not illustrated) provided for the feeding motor 57, the transport motor 58, and the separation motor 59, respectively, are also input to the control section 50, and so the control section 50 is capable of ascertaining the rotation amount of each of the motors.

The control section 50 is provided with a CPU 60, a flash ROM 61, and a RAM 62. The CPU 60 performs various arithmetic processes according to a program stored in the flash ROM 61 and controls the operation of the scanner 1 as a whole. The flash ROM 61, which is an example of a storage unit, is a readable and writable nonvolatile memory. Various setting information input by the user via the operation panel 7 is also stored in the flash ROM 61. The RAM 62, which is an example of a storage unit, temporarily stores various information.

The control section 50 is provided with an interface 63 and is capable of communication with an external computer 90 is possible via the interface 63.

Next, each detection section provided on the document transport path T will be described.

The placement detection section 54 is a detection section provided upstream of the feeding roller 14. The control section 50 is capable of detecting whether or not a document is present on the top cover 10 based on the signal transmitted from the placement detection section 54.

The first document detection section 52 serving as the "first detection section" is a detection section provided between the feeding roller 14 and the transport roller pair 16. The control section 50 is capable of detecting the passage of the leading end or the trailing end of the document based on the signal transmitted from the first document detection section 52. The placement detection section 54 and the first document detection section 52 may be non-contact sensors or contact sensors.

The multi-feeding detection section 51 is a detection section provided between the feeding roller 14 and the transport roller pair 16, and is provided with an ultrasonic wave transmitting section and an ultrasonic wave receiving section that are arranged to face each other with the document feeding path T interposed therebetween. The control section 50 is capable of detecting the multi-feeding of the document based on the signal transmitted from the multi-feeding detection section 51.

The second document detection section 53 serving as the "second detection section" is a detection section provided between the transport roller pair 16 and the reading section 20, and the control section 50 is capable of detecting the passage of the leading end or trailing end of the document using the signal transmitted from the second document detection section 53. The second document detection section 53 may be a non-contact sensor or a contact sensor.

Next, with reference to FIGS. 6 to 9, a curve forming portion provided in the vicinity of the feeding roller 14 and the separation roller 15 will be described.

When the preceding document is fed out, the succeeding document is also about to be fed out due to the frictional force between the preceding document and the succeeding document. At this time, although the leading end of the succeeding document is blocked by the separation roller 15, when the rigidity of the succeeding document is low, the leading end of the succeeding document may curve along the feeding direction upstream of the nipping position between the separation roller 15 and the feeding roller 14 and cause a jam later. When the trailing end of the preceding document passes through the nipping position, since the separation roller 15 rotates in reverse by a predetermined amount, the bending is also caused by the reverse rotation of the separation roller 15.

Figure 8:
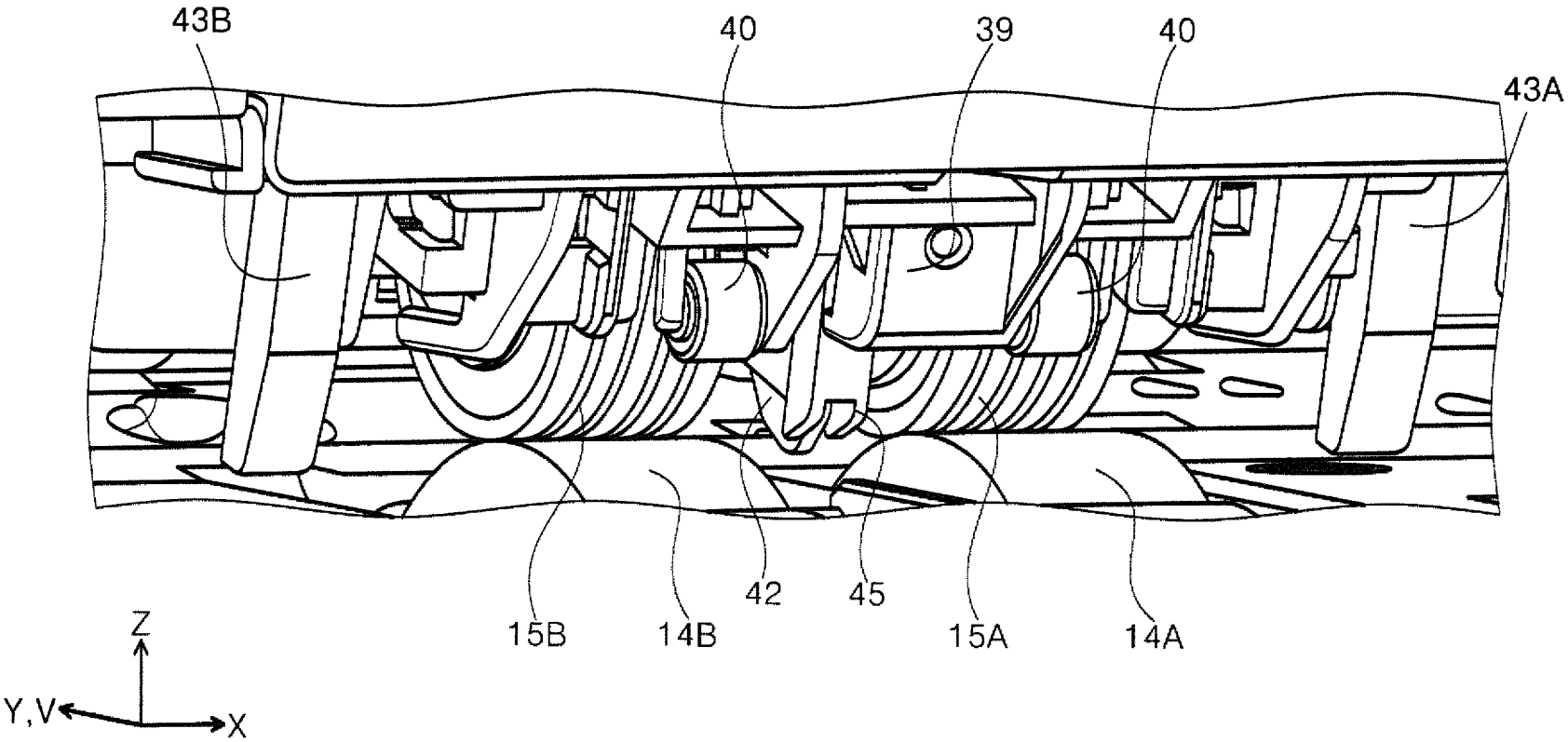
FIG. 8 is a perspective view of the vicinity of a feeding roller and a separation roller.
Figure 9:
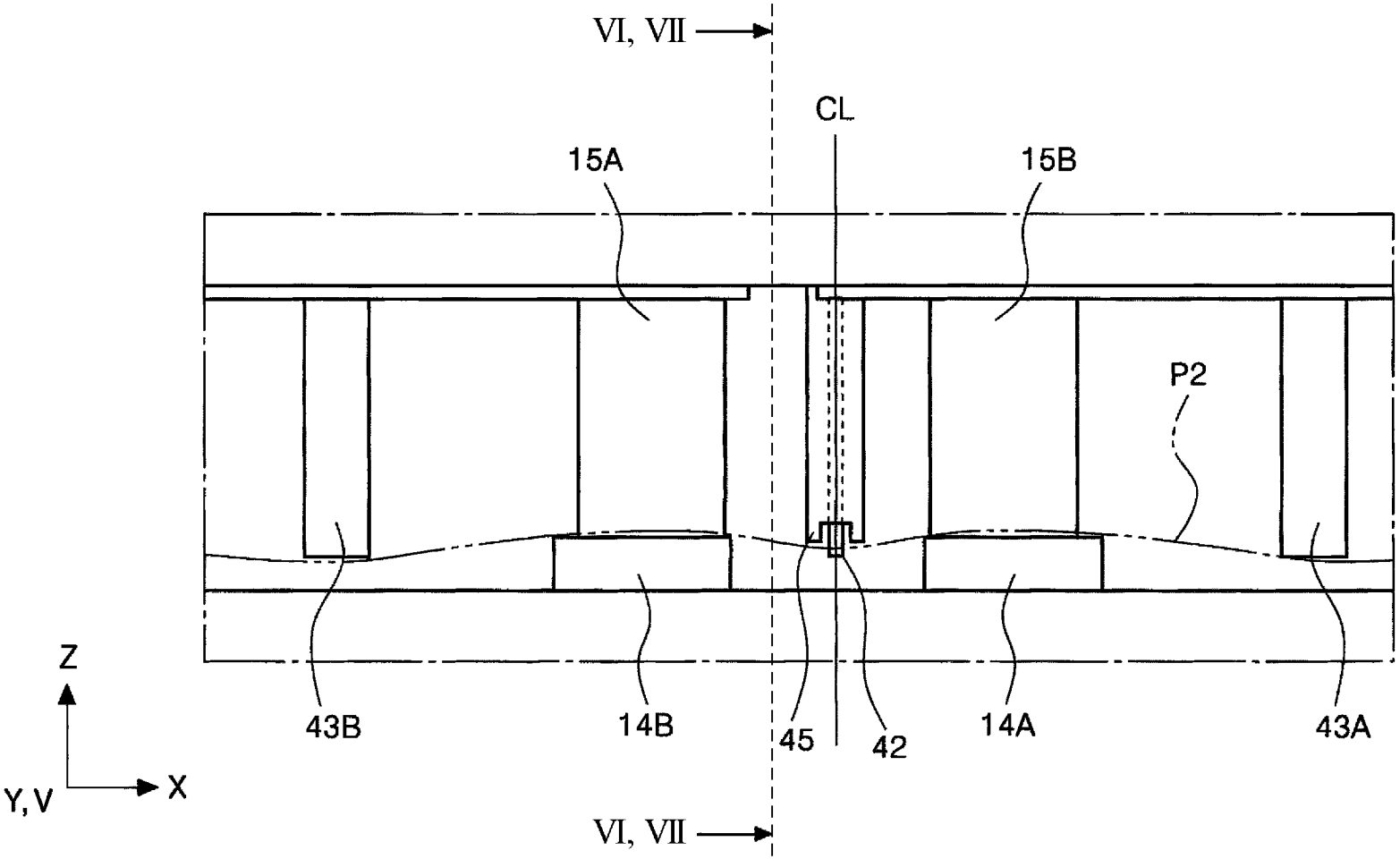
FIG. 9 is a front view of the vicinity of the feeding roller and the separation roller.

In order to suppress the bending of the leading end of the as described above, the present embodiment is provided with a configuration for forming a curve along the width direction with respect to the leading end of the succeeding document. In FIGS. 8 and 9, reference numeral 14A is a first feeding roller and reference numeral 14B is a second feeding roller. In other words, in the present embodiment, a plurality of feeding rollers 14 is provided, and the plurality of feeding rollers 14 includes the first feeding roller 14A and the second feeding roller 14B provided to leave an interval between itself and the first feeding roller 14A in the document width direction.

Similarly, a plurality of separation rollers 15 is provided, and the plurality of separation rollers 15 includes a first separation roller 15A facing the first feeding roller 14A and a second separation roller 15B facing the second feeding roller 14B.

In FIG. 9, a straight line CL indicates the center position in the document width direction, and when the center position in the width direction of the fed document is set appropriately on the top cover 10 (refer to FIG. 2), any size of document will match the center position CL. The first separation roller 15A and the second separation roller 15B are disposed to be horizontally symmetrical with respect to the center position CL, and the first feeding roller 14A and the second feeding roller 14B are disposed to be left-right symmetrical with respect to the center position CL.

The first curve forming portion 45 and a fourth curve forming portion 42, which will be described later, are provided at the position of the center position CL, and a second curve forming portion 43A and a third curve forming portion 43B are disposed to be left-right symmetrical with respect to the center position CL.

The first curve forming portion 45 that forms a curve along the document width direction with respect to the document is provided. The first curve forming portion 45 is upstream of the nipping position N between the feeding roller 14 and the separation roller 15 in the feeding direction as illustrated in FIG. 6, and contacts the document between the first separation roller 15A and the second separation roller 15B in the document width direction as illustrated in FIGS. 8 and 9.

Figure 6:
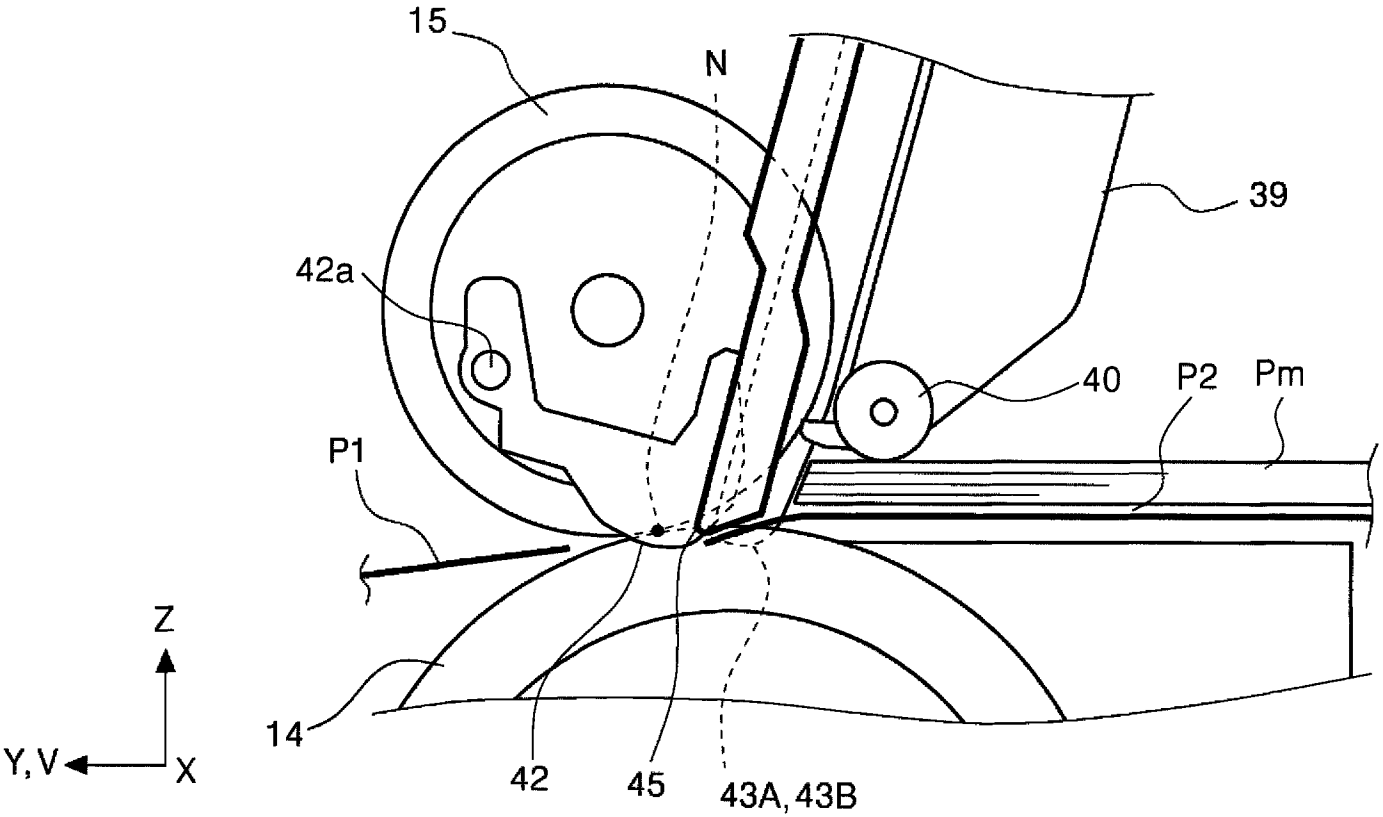
FIG. 6 is a sectional diagram taken along a line VI, VII-VI, VII in FIG. 9, in which each curve forming portion is in a first state.

As illustrated in FIGS. 6 and 9, the first curve forming portion 45 is configured such that the part in contact with the document is positioned closer to the rotation center direction of the feeding roller 14 than the outer circumferential surface of the feeding roller 14, and the state is maintained. In the present embodiment, the overlap amount between the first curve forming portion 45 and the feeding roller 14 when viewed in the document width direction is set to 0.25 mm to 0.75 mm.

According to this configuration, a curve along the document width direction is formed at the leading end of a succeeding document P2 as illustrated in FIG. 9 and the rigidity in the feeding direction is improved. Accordingly, it is possible to suppress the bending of the leading end of the succeeding document P2 along the feeding direction upstream of the nipping position N between the separation roller 15 and the feeding roller 14, and thus it is possible to suppress jamming.

The first curve forming portion 45 has an inclined surface in which the upstream surface in the feeding direction is inclined obliquely downward, and the bottom end portion has a shape that increases the overlap amount with the feeding roller 14 toward downstream in the feeding direction. Accordingly, the leading end of the document is less easily caught on the first curve forming portion 45.

In the present embodiment, as illustrated in FIGS. 8 and 9, together with the first curve forming portion 45, the second curve forming portion 43A and the third curve forming portion 43B that form a curve in the document along the document width direction are provided. The second curve forming portion 43A and the third curve forming portion 43B are members provided as a pair.

The second curve forming portion 43A contacts the document upstream of the nipping position N between the feeding roller 14 and the separation roller 15 in the feeding direction as illustrated in FIG. 6 at a position separated from the first separation roller 15A in the first direction (the +X direction), which is one of the document width directions, in the document width direction as illustrated in FIGS. 8 and 9, and a state in which the part in contact with the document is positioned closer to the rotation center direction of the feeding roller 14 than the outer circumferential surface of the feeding roller 14 is maintained.

The third curve forming portion 43B contacts the document upstream of the nipping position N in the feeding direction between the feeding roller 14 and the separation roller 15 as illustrated in FIG. 6 at a position separated from the second separation roller 15B in the second direction (the −X direction), which is the opposite direction from the first direction (the +X direction), in the document width direction as illustrated in FIGS. 8 and 9, and a state in which the part in contact with the document is positioned closer to the rotation center direction of the feeding roller 14 than the outer circumferential surface of the feeding roller 14 is maintained.

In the present embodiment, the overlap amount of the second curve forming portion 43A and the third curve forming portion 43B with the feeding roller 14 when viewed from the document width direction is set to approximately 1.0 mm.

The second curve forming portion 43A and the third curve forming portion 43B configured in this manner, it is possible to more reliably form a curve along the document width direction at the leading end of the succeeding document P2 as illustrated in FIG. 9, it is possible to more reliably suppress the bending of the leading end of the succeeding document P2 along the feeding direction upstream of the nipping position between the separation roller 15 and the feeding roller 14, and thus it is possible to more reliably suppress jamming.

In the present embodiment, the fourth curve forming portion 42 is provided. The fourth curve forming portion 42 is provided to be capable of swinging in the clockwise direction and the counterclockwise direction in FIG. 6 around a swinging shaft 42*a* illustrated in FIG. 6 and is pressed in the clockwise direction in FIG. 6 by a spring (not illustrated). The fourth curve forming portion 42 moves back and forth with respect to the document feeding path by swinging and advances into the document feeding path to form a curve along the document width direction with respect to the document. FIG. 6 illustrates a state in which the fourth curve forming portion 42 is advanced into the document feeding path.

In the present embodiment, the fourth curve forming portion 42 is at a position containing the nipping position N between the feeding roller 14 and the separation roller 15 in the document feeding direction and contacts the document between the first separation roller 15A and the second separation roller 15B in the document width direction as illustrated in FIGS. 8 and 9. In the present embodiment, the overlap amount between the fourth curve forming portion 42 and the feeding roller 14 when viewed from the document width direction is set to approximately 1.0 mm.

By forming a curve along the document width direction in the document using the fourth curve forming portion 42 as described above, the rigidity in the document feeding direction is improved, and particularly, the leading end of the document is capable of reliably proceeding downstream of the nipping position N between the separation roller 15 and the feeding roller 14, and thus it is possible to suppress jamming downstream of the nipping position N.

As illustrated in FIG. 6, the first curve forming portion 45 and the fourth curve forming portion 42 are formed to be smoothly coupled so as to not form large unevenness in the feeding path along the feeding direction at the respective bottom end portions when viewed from the document width direction. In the present embodiment, as illustrated in FIG. 9, the width of the fourth curve forming portion 42 in the document width direction is smaller than the width of the first curve forming portion 45, but may be formed larger than the width of the first curve forming portion 45.

Through user operation, the first curve forming portion 45 with the second curve forming portion 43A and the third curve forming portion 43B are configured to be capable of switching between a first state in which a curve is formed in the document and a second state in which the curve forming portions 45, 43A, and 43B are positioned in a direction more withdrawn from the document feeding path than in the first state. This state switching is performed by the user operating the switching lever 8 described with reference to FIG. 2. Hereinafter, when it is not necessary to particularly distinguish the first curve forming portion 45, the second curve forming portion 43A, and the third curve forming portion 43B, they will be referred to as "each curve forming portion".

When the switching lever 8 is in the "normal position" and the "non-separation position", each of the curve forming portions rises to the second state, and when the switching lever 8 is in the "soft separation position", each of the curve forming portions is lowered to the first state.

Although a detailed description will be given later, the document feeding at the soft separation position is permitted when the apparatus main body portion 2 is in the second reading posture (the bottom diagram of FIG. 4), and the document feeding at the normal position and the non-separation position is permitted when the apparatus main body portion 2 is in the first reading posture (the center diagram of FIG. 4).

Usage of the non-separation position is recommended when the document to be transported is in the form of a booklet, and usage of the soft separation position is recommended for documents that are difficult to separate or that do not easily feed, for example, documents that have strong adherence between documents such as extremely thin documents and glossy paper.

When the switching lever 8 is switched to the soft separation position, the pressing force by the spring (not illustrated) that presses the separation roller 15 toward the feeding roller 14 is a second pressing force less than a first pressing force of the normal position according to an adjustment mechanism (not illustrated). When the switching lever 8 is switched to the non-separation position, a switching mechanism (not illustrated) causes a non-transmission state to be assumed in which the drive force from the separation motor 59 is not transmitted to the separation roller 15.

As described above, by the user operation, since it is possible to switch each of the curve forming portions between the first state in which a curve is formed in the document, and the second state in which each of the curve forming portions is positioned in a direction more withdrawn from the document feeding path than in the first state, when feeding a thick document having high rigidity, it is possible to suppress each of the curve forming portions interfering with the feeding of the document by setting each of the curve forming portions to the second state.

Figure 7:
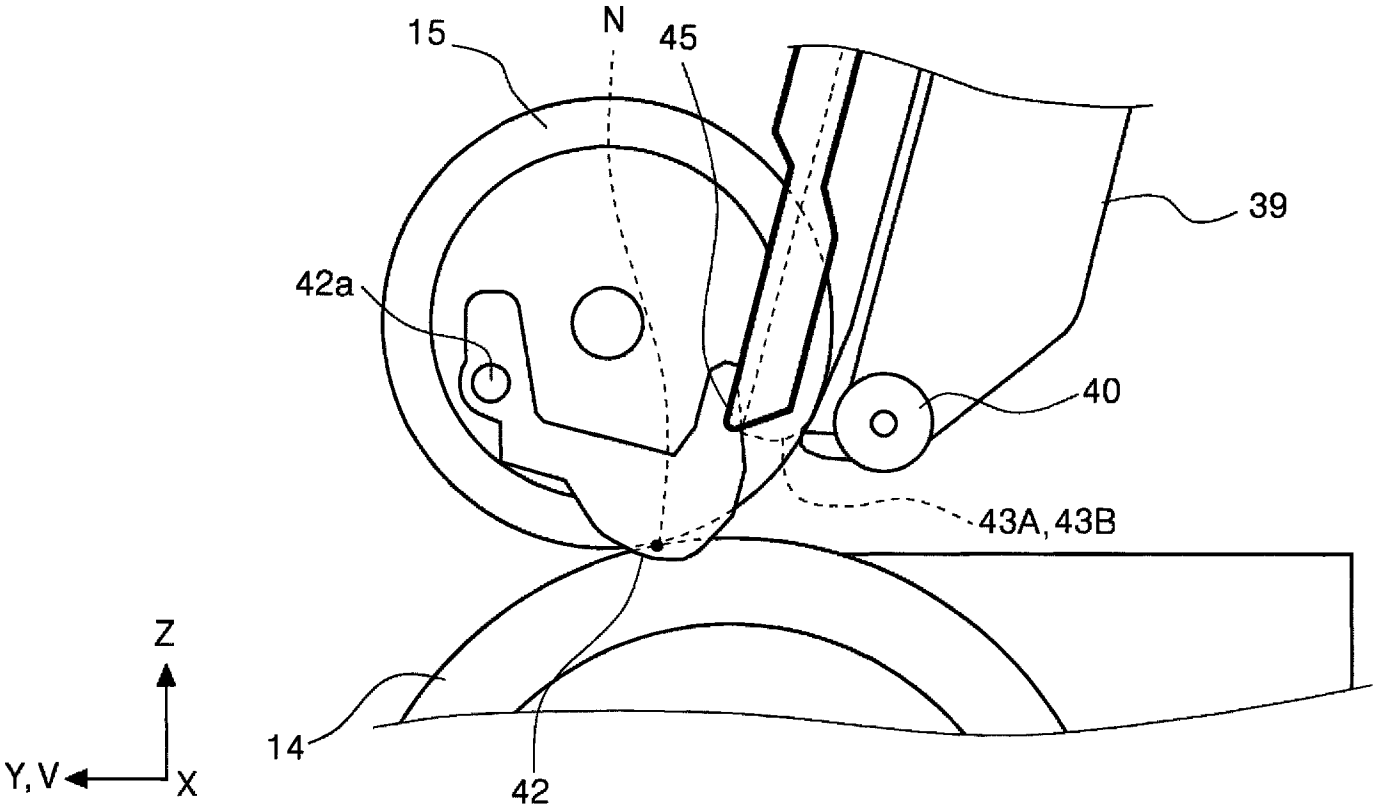
FIG. 7 is a sectional diagram taken along the line VI, VII-VI, VII in FIG. 9, in which each of the curve forming portions is in a second state.

FIG. 6 illustrates a state in which each of the curve forming portions is in the first state, and FIG. 7 illustrates a state in which each of the curve forming portions is in the second state. FIGS. 8 and 9 illustrate a state in which each of the curve forming portions is in the first state.

Since the fourth curve forming portion 42 is capable of moving back and forth with respect to the document feeding path, when a thick and highly rigid document is fed, the fourth curve forming portion 42 is capable of withdrawing from the document feeding path by swinging.

In the embodiment, the switching lever 8 (refer to FIG. 2) and each of the curve forming portions are engaged via a link mechanism (not illustrated), that is, although the state switching of each of the curve forming portions is performed by the operating force of the user without using a power source, for example, a configuration may be adopted in which a power source such as a solenoid or a motor is used and each of the curve forming portions is displaced by the power source according to the operation of the switching lever 8.

In the embodiment, although each of the curve forming portions is provided in a fixed manner so as not to be displaced upward at least in the first state and is provided so as not to be displaced upward due to the force received from the document, for example, each of the curve forming portions may be provided to be pressed toward the first state by a spring having a large spring force and to not be displaced upward by at least the force received from the document.

Next, a plurality of feeding modes will be described with reference to FIGS. 5 and 10.

Figure 10:
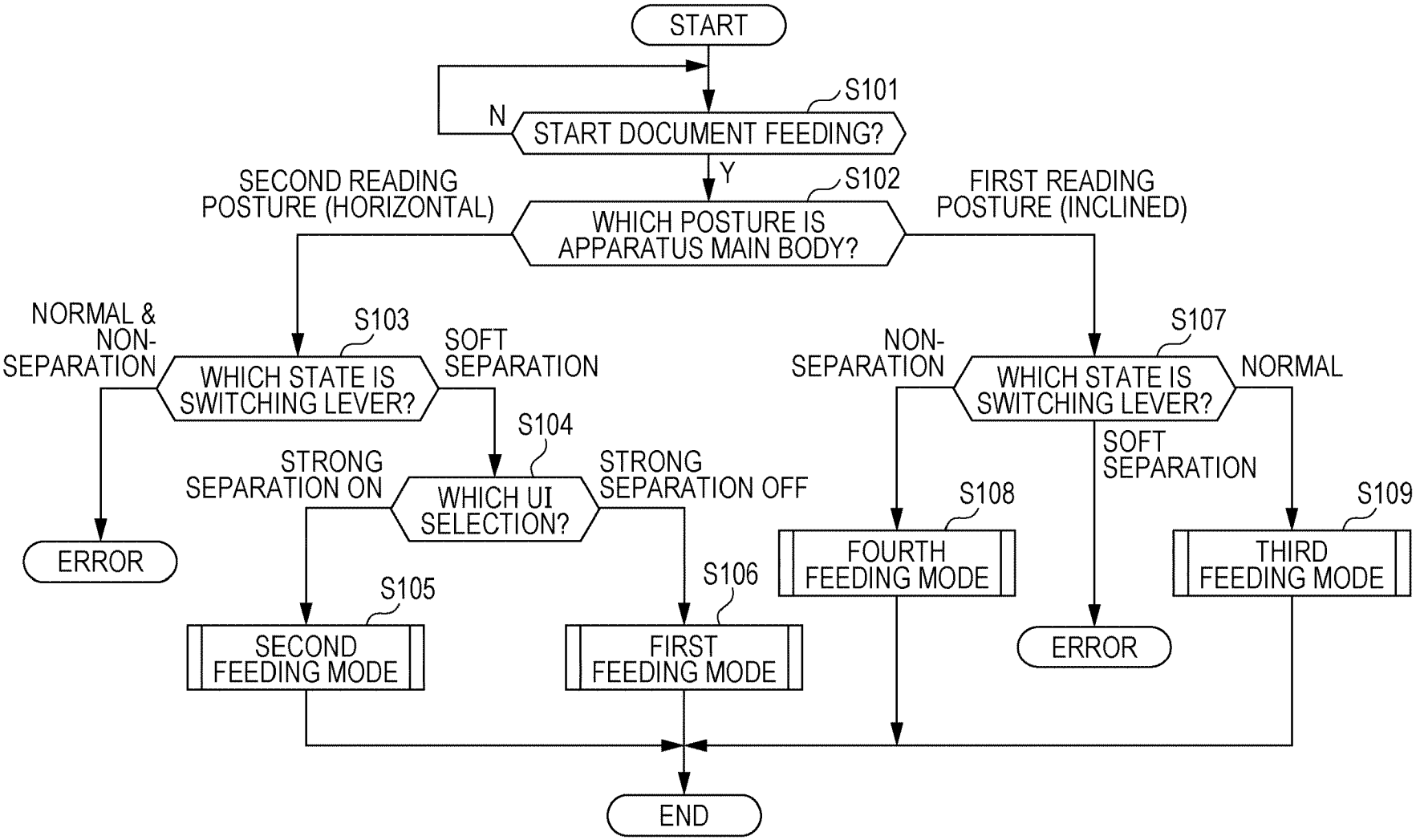
FIG. 10 is a flowchart illustrating a flow of determining a feeding mode.

In FIG. 10, when the control section 50 receives the document feeding start instruction (Yes in step S101), the control section 50 determines the posture of the apparatus main body portion 2 based on the detection signal of the posture detection section 49 (step S102). As a result, in the case of the first reading posture (the center diagram of FIG. 4), if the state of the switching lever 8 (refer to FIG. 2) is further determined based on the detection signal of the lever detection section 48 (step S107) and the normal position is assumed, the third feeding mode is executed (step S109), and the non-separation position is assumed, the fourth feeding mode is executed (step S108). In the case of the soft separation position, error processing such as an alert display on the operation panel 7 indicating that the posture of the apparatus main body portion 2 is inappropriate is performed.

In step S102, when the posture of the apparatus main body portion 2 is the second reading posture (the bottom diagram of FIG. 4), the control section 50 further determines the state of the switching lever 8 (refer to FIG. 2) based on the detection signal of the lever detection section 48 (step S103). If the soft separation position is assumed, the control section 50 determines whether the selection of the user with respect to the user interface (hereinafter referred to as the "UI") displayed on the operation panel 7 is strong separation ON or strong separation OFF (step S104), and executes the first feeding mode if strong separation OFF is selected (step S106) and executes the second feeding mode if the strong separation ON is selected (step S105).

Figure 12:
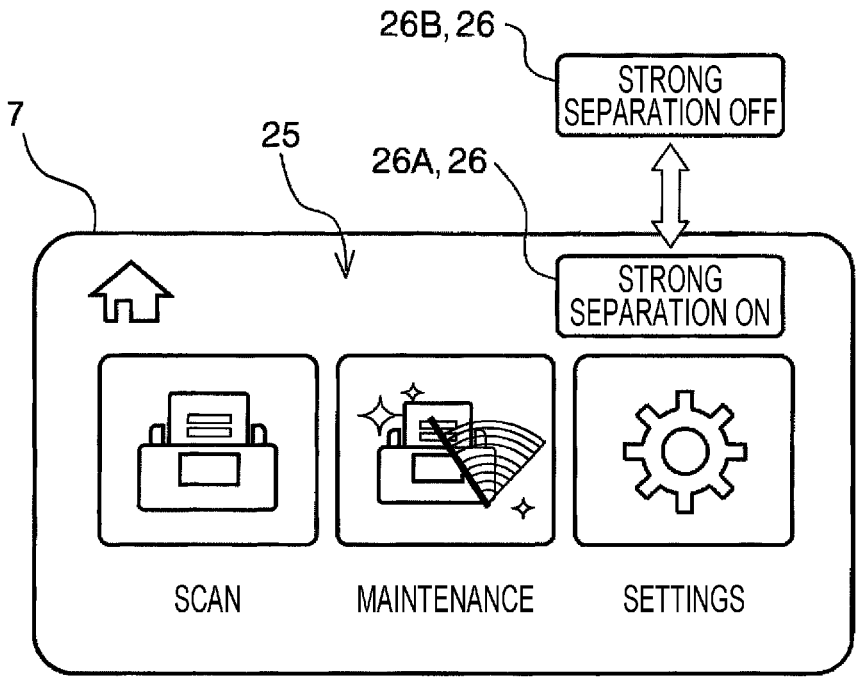
FIG. 12 is a diagram illustrating an example of a user interface displayed on an operation panel.

It is possible to set the UI displayed on the operation panel 7 as illustrated in FIG. 12, for example. A switching icon 26 is displayed on the UI indicated by reference numeral 25 in FIG. 12, and by the user touching the switching icon 26, it is possible to switch between the state of strong separation ON indicated by reference numeral 26A and the state of strong separation OFF indicated by reference numeral 26B.

The switching icon 26 illustrated in FIG. 12 is displayed only when the posture of the apparatus main body portion 2 is the second reading posture (the bottom diagram of FIG. 4), and is not displayed in other postures.

When the switching lever 8 (refer to FIG. 2) is in the normal position or the non-separation position in step S103 of FIG. 10, the control section 50 performs error processing such as displaying an alert on the operation panel 7 indicating that the posture of the apparatus main body portion 2 is inappropriate. However, instead of such control, the first feeding mode may be executed when the switching lever 8 is in the normal position in step S103, and the fourth feeding mode may be executed when the switching lever 8 is in the non-separation position.

The instruction to start the document feeding is received when the apparatus main body portion 2 is in the first reading posture or the second reading posture, and the apparatus main body portion 2 is in the non-use posture (the top diagram of FIG. 4), the instruction to start the document feeding is not received.

FIG. 11 compiles the differences between the first feeding mode, the second feeding mode, the third feeding mode, and the fourth feeding mode.

Among the elements (1) to (7) configuring each feeding mode, the elements (1), (2), and (3) are switched by the position operation of the switching lever 8 (refer to FIG. 2) as described above, and the elements (4), (5), (6), and (7) are switched by the control of the control section 50.

As will be described later in detail, for example, in the first feeding mode, the control section 50 intermittently drives the separation motor 59 and makes the driving speed of the separation motor 59 slower than in the other feeding modes. In the second feeding mode, the control section 50 does not use the first document detection section 52 and the multi-feeding detection section 51.

Figure 13:
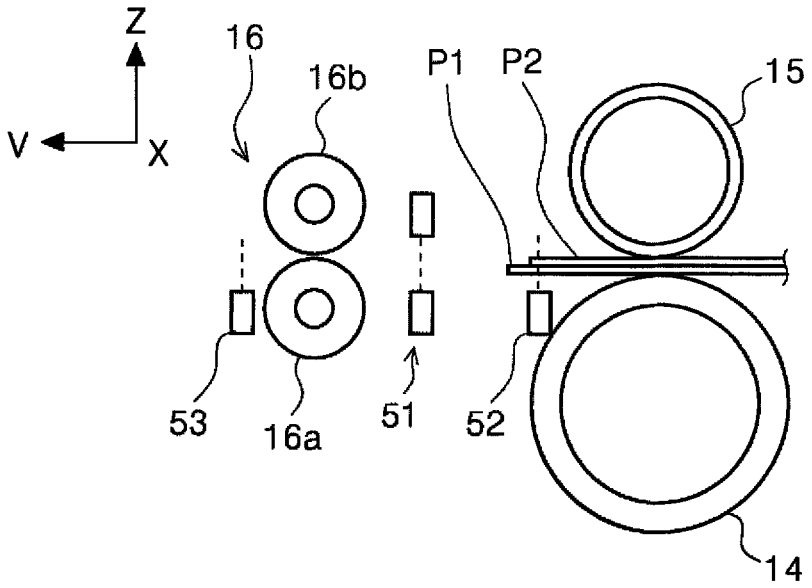
FIG. 13 is a diagram illustrating a state of multi-feeding of documents.

Before describing each feeding mode in detail, a problem during the document feeding will be described with reference to FIG. 13. In FIG. 13, reference numeral P1 indicates a preceding document, and reference numeral P2 indicates a succeeding document. When the adhesive force between documents such as glossy paper is strong, the adhesive force between the documents overcomes the separating action of the separation roller 15, the preceding document P1 and the succeeding document P2 proceed to the downstream without being separated, and multi-feeding is detected by the multi-feeding detection section 51. In this case, although it is also possible to stop the feeding of the document, there is are cases in which the succeeding document P2 may be prevented from reaching the transport roller pair 16, and by extension, the reading area of the reading section 20 by continuously performing separation using the separation roller 15, and when the document feeding operation is consistently stopped, including such cases that are possible to save, the usability of the apparatus is impaired.

Therefore, in the present embodiment, the control section 50 is configured to be capable of executing each of the feeding modes described above, particularly the second feeding mode.

Hereinafter, the first feeding mode, the second feeding mode, and the third feeding mode will be described. In the fourth feeding mode, since the continuous feeding of a plurality of documents is not performed, the description using the timing chart will be omitted hereinafter.

Third Feeding Mode

First, with reference to FIG. 14, a third feeding mode executed in a state in which the apparatus main body portion 2 is in the first reading posture (the center diagram of FIG. 4) and the switching lever 8 is in the normal position will be described. The third feeding mode is assumed to be the most frequently used feeding mode, such as when the document is normal paper.

Figure 14:
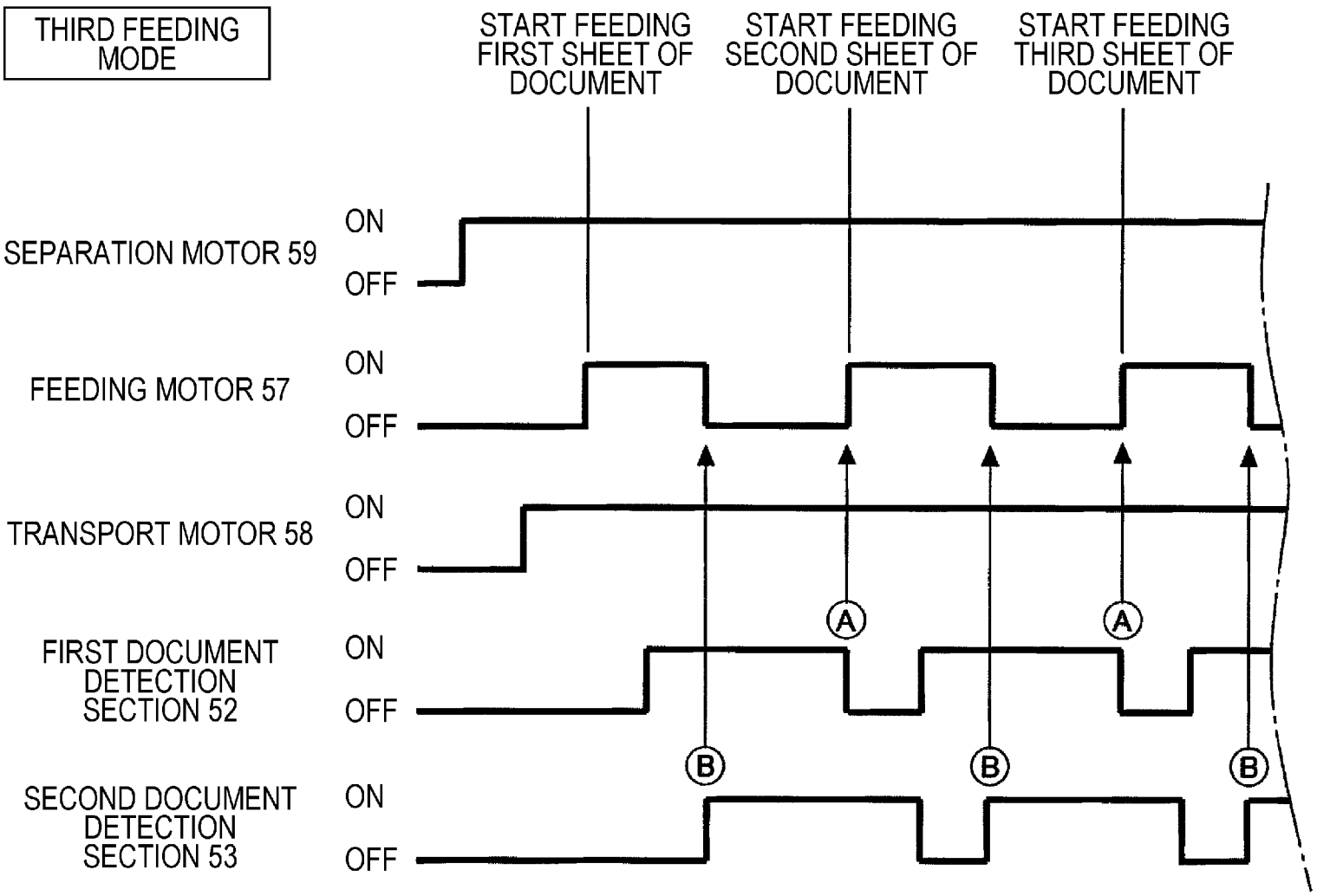
FIG. 14 is a timing chart illustrating state changes of each motor and each sensor in a third feeding mode.
Figure 15:
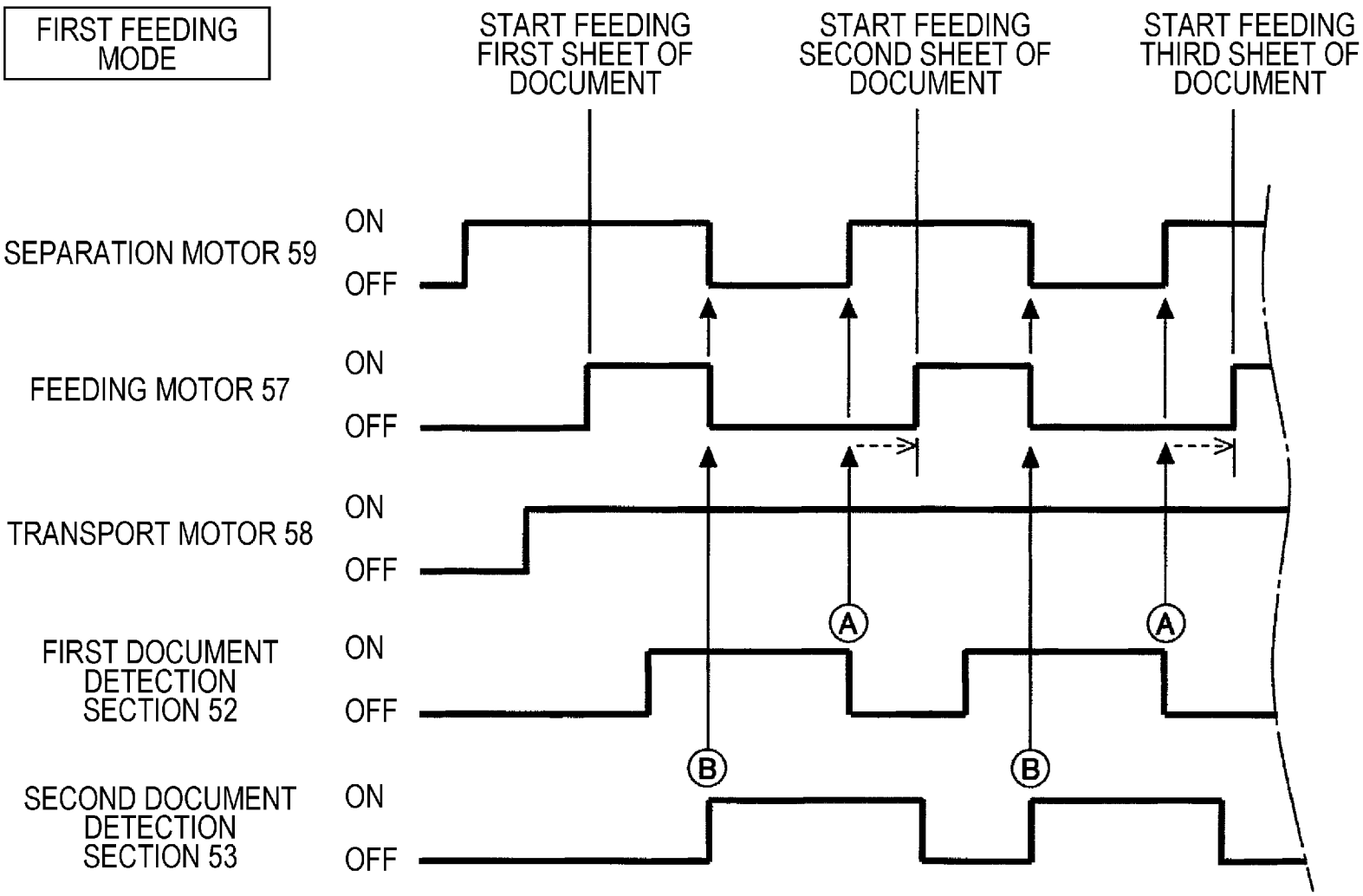
FIG. 15 is a timing chart illustrating state changes of each motor and each sensor in a first feeding mode.
Figure 16:
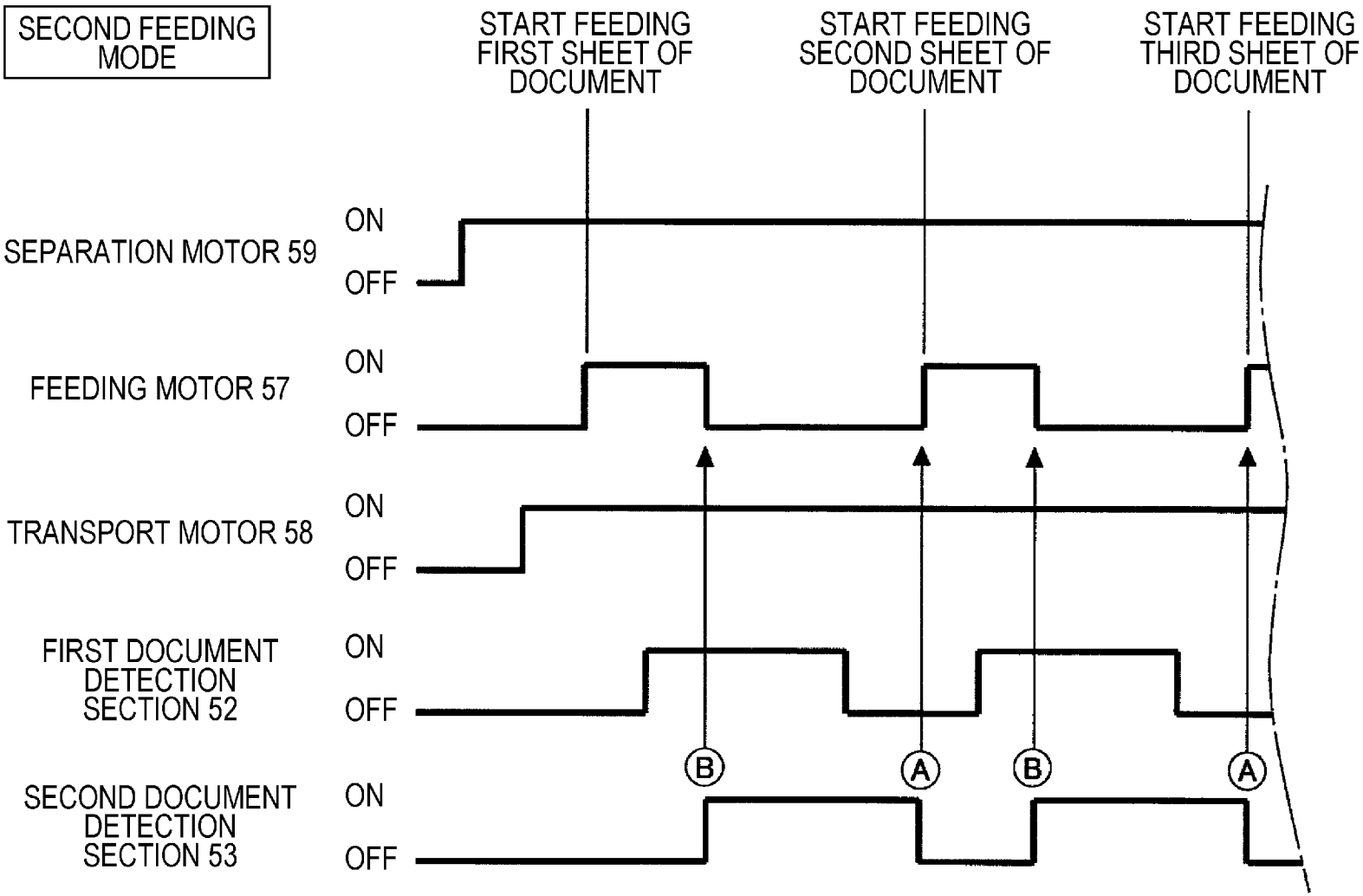
FIG. 16 is a timing chart illustrating state changes of each motor and each sensor in a second feeding mode.

In FIG. 14, when the control section 50 receives an instruction to start the feeding operation, the control section 50 first starts the driving of the separation motor 59, starts the driving of the transport motor 58 after a lapse of a predetermined time, and further starts the driving of the feeding motor 57 after a lapse of a predetermined time, that is, starts the document feeding of the first sheet. When the control section 50 detects the leading end of the first document, that is, the preceding document using the second document detection section 53, the control section 50 stops the driving of the feeding motor 57. In FIGS. 14 to 16, the positions of the arrows B indicate the rising timing of the signal used to determine the drive stop timing of the feeding motor 57.

Next, when the trailing end of the document that is the first sheet, that is, the preceding document is detected using the first document detection section 52, the control section 50 starts the driving of the feeding motor 57, that is, starts the document feeding of the second sheet. In FIGS. 14 to 16, the positions of the arrows A indicate the rising timing of the signal used to determine the drive start timing of the feeding motor 57.

Hereinafter, the document feeding of the third and succeeding sheets is similarly performed.

First Feeding Mode

Next, with reference to FIG. 15, a first feeding mode executed in a state in which the apparatus main body portion 2 is in the second reading posture (the bottom diagram of FIG. 4) and the switching lever 8 is in the soft position will be described. The first feeding mode is a feeding mode used when a document to be read is thin and is easily damaged.

In FIG. 15, when the control section 50 receives an instruction to start the feeding operation, the control section 50 first starts the driving of the separation motor 59, starts the driving of the transport motor 58 after a lapse of a predetermined time, and further starts the driving of the feeding motor 57 after a lapse of a predetermined time, that is, starts the document feeding of the first sheet. When the control section 50 detects the leading end of the first document, that is, the preceding document using the second document detection section 53, the control section 50 stops the driving of the feeding motor 57, and at the same time, the driving the separation motor 59 is stopped.

Next, when the first document detection section 52 detects the trailing end of the first document, that is, the trailing end of the preceding document, the control section 50 first starts the driving of the separation motor 59, and after a lapse of a predetermined time, drives the feeding motor 57, that is, start the document feeding of the second sheet.

Hereinafter, the document feeding of the third and succeeding sheets is similarly performed. In this manner, in the first feeding mode, the separation motor 59 is driven intermittently. As described with reference to FIG. 11, in the first feeding mode, the driving speed of the separation motor 59 is set to be lower than in the other feeding modes.

In the first feeding mode, when the second document detection section 53 detects the passage of the trailing end of the preceding document before the first document detection section 52 detects the passage of the trailing end of the preceding document, it is determined that the leading end of the succeeding document is approaching the first document detection section 52 and the feeding of the succeeding document is stopped. When the multi-feeding detection section 51 detects the multi-feed of the document, the feeding of the succeeding document is stopped.

Second Feeding Mode

Next, with reference to FIG. 16, a second feeding mode executed in a state in which the apparatus main body portion 2 is in the second reading posture (the bottom diagram of FIG. 4) and the switching lever 8 is in the soft position will be described. The second feeding mode is a feeding mode used when the adhesive force between documents is strong such as when the document to be read is glossy paper.

In FIG. 16, when the control section 50 receives an instruction to start the feeding operation, the control section 50 first starts the driving of the separation motor 59, starts the driving of the transport motor 58 after a lapse of a predetermined time, and further starts the driving of the feeding motor 57 after a lapse of a predetermined time, that is, starts the document feeding of the first sheet. When the control section 50 detects the leading end of the first document, that is, the preceding document using the second document detection section 53, the control section 50 stops the driving of the feeding motor 57.

Next, when the trailing end of the document that is the first sheet, that is, the preceding document is detected using the second document detection section 53, the control section 50 starts the driving of the feeding motor 57, that is, starts the document feeding of the second sheet.

Hereinafter, the document feeding of the third and succeeding sheets is similarly performed. In this manner, in the second feeding mode, as compared with the first feeding mode, the feeding start timing of the succeeding document is determined using the trailing end detection signal of the preceding document using the second document detection section 53 instead of the first document detection section 52.

In the second feeding mode, the first document detection section 52 and the multi-feeding detection section 51 are not used as illustrated in FIG. 11. Here, "not using the detection sections" is not limited to a form in which the detection signal is not used even if the detection signal is received from the detection sections, and any form may be used as long as the form does not use the detection signal as a result, such as stopping the power supply to the detection sections themselves.

When the trailing end of the preceding document is detected by the second document detection section 53, the driving of the feeding motor 57 is not started immediately, and the driving of the feeding motor 57 may be started after a predetermined standby time. Accordingly, it is possible to appropriately form an interval between the trailing end of the preceding document and the leading end of the succeeding document.

As described above, the control section 50 is provided with the first feeding mode and the second feeding mode. In the first feeding mode, when the first document detection section 52 detects the passage of the trailing end of the preceding document in the feeding standby state in which the driving of the feeding roller 14 is stopped, the control section 50 starts the driving of the feeding roller 14 to perform the feeding of the succeeding document, and when the second document detection section 53 detects the passage of the trailing end of the preceding document before the first document detection section 52 detects the passage of the trailing end of the preceding document, the control section 50 stops the feeding of the succeeding document. The second feeding mode is a feeding mode that does not use the first document detection section 52, and in this mode, when the second document detection section 53 detects the passage of the trailing end of the preceding document in the feeding standby state, the control section 50 starts the driving of the feeding roller 14 to perform the feeding of the succeeding document.

In other words, document feeding method in the document feeding apparatus 9 is capable of switching between the first feeding mode and the second feeding mode. In the first feeding mode, when the first document detection section 52 positioned downstream of the feeding roller 14 in the document feeding direction detects the passage of the trailing end of the preceding document in the feeding standby state in which the driving of the feeding roller 14 that feeds the document is stopped, the driving of the feeding roller 14 is started to perform the feeding of the succeeding document. In the second feeding mode, when the second document detection section 53 positioned downstream of the first document detection section 52 in the document feeding direction detects the passage of the trailing end of the preceding document in the feeding standby state, the driving of the feeding roller 14 is started to perform the feeding of the succeeding document.

Therefore, in the second feeding mode, it is possible to lengthen the stopping period of the feeding roller 14, that is, the separation period of the separation roller 15 as compared with in the first feeding mode, and the separation of the preceding document and the succeeding document from each other may be anticipated even if a multi-feeding state occurs such as when the leading end of the succeeding document exceeds the separation roller 15 and is further approaching the first document detection section 52. Therefore, it is possible to improve the usability of the apparatus as compared with a case in which the multi-feeding is determined based on the detection information of the first document detection section 52 and the feeding of the succeeding document is stopped.

In the first feeding mode, when the first document detection section 52 upstream of the second document detection section 53 detects the passage of the trailing end of the preceding document, the driving of the feeding roller 14 is started to perform the feeding of the succeeding document, and so it is possible to narrow the interval between the preceding document and the succeeding document as compared with in the second feeding mode, and it is possible to improve the throughput.

As described above, when the user places an emphasis on separation performance, it is possible to perform the feeding even with a document that does not separate easily by selecting the second feeding mode, and when the user places an emphasis on throughput, it is possible to suppress a reduction in the throughput by selecting the first feeding mode, and so it is possible to realize an apparatus with good usability.

In the present embodiment, the multi-feeding detection section 51 capable of detecting the multi-feeding of the document is provided upstream of the transport roller pair 16 and downstream of the first document detection section 52 in the document feeding direction. In the first feeding mode, the control section 50 uses the multi-feeding detection section 51 and in the second feeding mode, the control section 50 does not use the multi-feeding detection section 51 (refer to FIG. 11). Therefore, even when the document is in the multi-feeding state, it is possible to continuously perform the separation using the separation roller 15 in the second feeding mode and the separation of the preceding document and the succeeding document may be anticipated.

The control section 50 applies a drive torque in the reverse rotation direction to the separation roller 15 in the first feeding mode and the second feeding mode and sets the rotation speed of the separation motor 59 in the second feeding mode to be faster than the rotation speed of the separation motor 59 in the first feeding mode (refer to FIG. 11). Accordingly, it is possible to improve the separation performance in the second feeding mode as compared with the first feeding mode.

In the first feeding mode, since the rotation speed of the separation motor 59 is lower than that in the second feeding mode, it is possible to suppress damage to the leading end of the document by the separation roller 15.

In the first feeding mode, the control section 50 intermittently applies the drive torque to the separation roller 15 in the reverse rotation direction, and in the second feeding mode, continuously applies the drive torque to the separation roller 15 in the reverse rotation direction, and so it is possible to improve the separation performance in the second feeding mode as compared with the first feeding mode.

In the first feeding mode, since the drive torque is intermittently applied to the separation roller 15 in the reverse rotation direction, it is possible to suppress damage to the leading end of the document by the separation roller 15. However, the present disclosure is not limited thereto, and the drive torque may be continuously applied to the separation roller 15 in the reverse rotation direction in the first feeding mode in the same manner as in the second feeding mode.

When the drive torque of the separation motor 59 is applied to the separation roller 15 in the second feeding mode, a period may be provided in which the application of the drive torque to the separation roller 15 in the forward rotation direction and the application of the drive torque to the separation roller 15 in the reverse rotation direction are performed alternately. Hereinafter, such a period is referred to as a "separation motor forward-and-reverse driving period". Accordingly, it is possible to generate a sliding action between the preceding document and the succeeding document in the upstream and downstream directions of the document feeding direction, and it is possible to promote the elimination of the adherence between the preceding document and the succeeding document.

It is possible to start the separation motor forward-and-reverse driving period after a lapse of a predetermined time since the driving of the feeding motor 57 is started, and it is possible to perform the separation motor forward-and-reverse driving period for a predetermined period.

The separation motor forward-and-reverse driving period is not limited to after the start of feeding the document, may be provided before the start of feeding the document, and may be provided both before and after the start of feeding the document.

In the second feeding mode, before the driving of the feeding roller 14 is started from the feeding standby state, a period may be provided in which the swinging of the set guide 29 (refer to FIG. 3), that is, the switching from the second state in which the document is brought into contact with the feeding roller 14 to the first state in which the document is not brought into contact with the feeding roller 14 and the switching from the first state to the second state are alternately performed. Hereinafter, such a period is referred to as a "set guide up-and-down period". By providing the set guide up-and-down period, it is possible to apply vibration to the document, and it is possible to promote the elimination of the adherence between the preceding document and the succeeding document.

The set guide up-and-down period is not limited to before the start of feeding the document, may be provided after the start of feeding the document, and may be provided both before and after the start of feeding the document.

In the second feeding mode, the leading end of the preceding document abuts against the transport roller pair 16 in a state in which the transport roller pair 16, that is, the transport motor 58 is stopped, and then once the feeding motor 57 is stopped for a predetermined period while continuing the reverse rotation operation of the separation motor 59, an operation in which the forward rotation operation of the transport motor 58 and the feeding motor 57 is restarted may be included. Hereinafter, such an operation is referred to as an "abutting separation operation". It is possible to promote the elimination of the adherence between the preceding document and the succeeding document due to the abutting separation operation.

The separation motor forward-and-reverse driving period, the set guide up-and-down period, and the abutting separation operation may all be adopted, any two may be adopted, or only one may be adopted.

When the apparatus main body portion 2 is switched from the first reading posture (the center diagram of FIG. 4) to the second reading posture (the bottom diagram of FIG. 4), the control section 50 deploys a user interface that enables the strong separation ON, that is, the selection of the second feeding mode on the operation panel 7 as illustrated in FIG. 12. In the second reading posture, since the document feeding direction is horizontal, it is possible to further suppress multi-feeding of documents.

In the present embodiment, a lever detection section 48 (refer to FIG. 5) is provided that detects the position of the switching lever 8 configured to be capable of switching between a first pressing force and a second pressing force smaller than the first pressing force with regard to the pressing force when the separation roller 15 is pressed against the feeding roller 14 by operating the switching lever 8 (refer to FIG. 2) provided on the apparatus main body portion 2. Only in a state in which the pressing force is the second pressing force in a state in which the apparatus main body portion 2 switches from the first reading posture to the second reading posture, the control section 50 deploys the UI on the operation panel 7 with which it is possible to select the second feeding mode.

In other words, since the second feeding mode is selectable only in a state in which the pressing force when the separation roller 15 is pressed against the feeding roller 14 is the second pressing force smaller than the first pressing force, it is possible to still further suppress the multi-feeding of the documents.

In addition, since each of the curve forming portions assume the first state of forming a curve in the document as illustrated in FIG. 11 in a state in which the pressing force when the separation roller 15 is pressed against the feeding roller 14 is the second pressing force, it is possible to promote the elimination of the adherence between the preceding document and the succeeding document.

Figure 17:
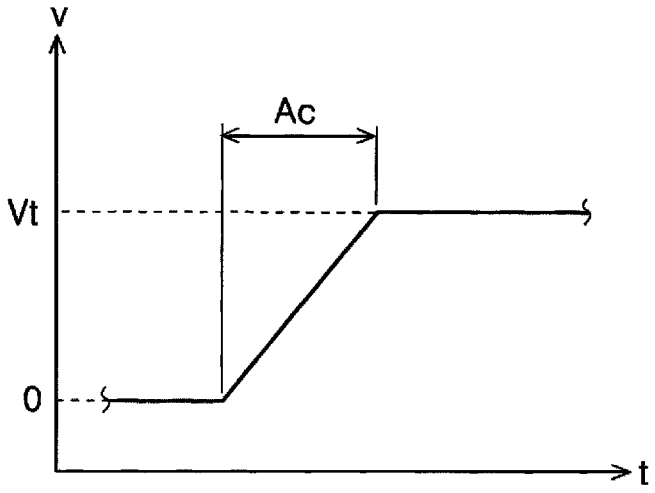
FIG. 17 is a diagram illustrating the rise of the rotation speed of a transport motor.

There are cases in which each motor temporarily stops due to factors such as buffer fullness in any of the feeding modes, and when the driving of each of the motors is restarted from the temporarily stopped state, there are cases in which the leading end of the document reaches the reading area before the speed stabilizes. In FIG. 17, a horizontal axis t is time, a vertical axis v is the motor rotation speed, and an interval Ac is an acceleration interval in which the motor transitions from the stop state to a constant speed Vt. When the second document detection section 53 detects the leading end of the document in the acceleration interval Ac, there is a concern that the reading area may be reached before the motor rotation speed reaches the constant speed Vt. Therefore, in this case, the control section 50 determines that there is an error and stops the reading.

The present disclosure is not limited to the embodiments described above, various modifications are possible within the scope of the present disclosure, and it goes without saying that the various modifications are also included in the scope of the present disclosure.

What is claimed is:

1. A medium feeding apparatus comprising:

a medium placement section on which a medium is placed before feeding;

a feeding roller that feeds the medium placed on the medium placement section;

a separation roller that nips the medium with the feeding roller to promote separation of the medium;

a transport roller that is positioned downstream in a medium feeding direction with respect to a medium nipping position between the feeding roller and the separation roller and that transports the medium downstream in the medium feeding direction;

a first detection section that is positioned upstream of the transport roller and downstream of the medium nipping position in the medium feeding direction and that detects passage of the medium;

a second detection section that is positioned downstream of the transport roller in the medium feeding direction and that detects the passage of the medium; and a control section that controls the feeding of the medium based on detection information of the first detection section and the second detection section, wherein the control section includes a first feeding mode in which when the first detection section detects the passage of a trailing end of a preceding medium in a feeding standby state in which driving of the feeding roller is stopped, the control section starts the driving of the feeding roller to perform feeding of a succeeding medium, and a second feeding mode which is a feeding mode that does not use the first detection section and in which when the second detection section detects the passage of the trailing end of the preceding medium in the feeding standby state, the control section starts the driving of the feeding roller to perform the feeding of the succeeding medium.

2. The medium feeding apparatus according to claim 1, wherein in the first feeding mode, after the control section starts the driving of the feeding roller to perform the feeding of the succeeding medium, when the second detection section detects the passage of the trailing end of the preceding medium before the first detection section detects the passage of the trailing end of the preceding medium, the control section stops the feeding of the succeeding medium.

3. The medium feeding apparatus according to claim 1, further comprising:

a multi-feeding detection section configured to detect multi-feeding of a medium and provided upstream of the transport roller and downstream of the first detection section in the medium feeding direction, wherein the control section uses the multi-feeding detection section in the first feeding mode and does not use the multi-feeding detection section in the second feeding mode.

4. The medium feeding apparatus according to claim 1, further comprising:

a separation roller drive motor that applies a drive torque to the separation roller in a first rotation direction in which the separation roller feeds the medium downstream and a second rotation direction which is the reverse of the first rotation direction; and a torque limiter which idles the separation roller in the first rotation direction regardless of the drive torque when the rotational torque applied to the separation roller in the first rotation direction exceeds a predetermined torque upper limit value, wherein the control section applies the drive torque to the separation roller in the second rotation direction in the first feeding mode and the second feeding mode, and renders a rotation speed of the separation roller drive motor in the second feeding mode faster than the rotation speed of the separation roller drive motor in the first feeding mode.

5. The medium feeding apparatus according to claim 1, further comprising:

a separation roller drive motor that applies a drive torque to the separation roller in a first rotation direction in which the separation roller feeds the medium downstream and a second rotation direction which is the reverse of the first rotation direction; and a torque limiter which idles the separation roller in the first rotation direction regardless of the drive torque when the rotational torque applied to the separation roller in the first rotation direction exceeds a predetermined torque upper limit value, wherein the control section intermittently applies the drive torque to the separation roller in the second rotation direction in the first feeding mode, and continuously applies the drive torque to the separation roller in the second rotation direction in the second feeding mode.

6. The medium feeding apparatus according to claim 1, further comprising:

a separation roller drive motor that applies a drive torque to the separation roller in a first rotation direction in which the separation roller feeds the medium downstream and a second rotation direction which is the reverse of the first rotation direction; and a torque limiter which idles the separation roller in the first rotation direction regardless of the drive torque when the rotational torque applied to the separation roller in the first rotation direction exceeds a predetermined torque upper limit value, wherein the control section provides a period in which application of the drive torque in the first rotation direction and application of the drive torque in the second rotation direction are alternately performed on the separation roller in the second feeding mode.

7. The medium feeding apparatus according to claim 1, further comprising:

a support member configured to switch between a first state in which the support member causes the medium to not contact the feeding roller by supporting the medium and a second state in which the support member causes the medium to contact the feeding roller and provided upstream of the medium nipping position between the feeding roller and the separation roller in the medium feeding direction, wherein the control section provides a period in which switching from the second state to the first state of the support member and switching from the first state to the second state of the support member are alternately performed before starting the driving of the feeding roller from the feeding standby state in the second feeding mode.

8. An image reading apparatus comprising:

a reading unit that reads a surface of a medium; and the medium feeding apparatus according to claim 1.

9. The image reading apparatus according to claim 8, further comprising:

an apparatus main body portion including the reading unit;

a support portion that supports the apparatus main body portion such that the apparatus main body portion is changeable in posture; wherein the apparatus main body portion is configured to switch between a first reading posture in which the medium feeding direction is directed to an obliquely downward direction, and a second reading posture in which the medium feeding direction is a horizontal direction or is a direction closer to the horizontal direction than in the first reading posture, and includes a posture detection section that detects the posture of the apparatus main body portion, and an operation section that displays various information and receives various operations, and when the apparatus main body portion switches from the first reading posture to the second reading posture, the control section deploys a user interface configured for selection of the second feeding mode on the operation section.

10. The image reading apparatus according to claim 9, further comprising:

a position detection unit configured to switch between a first pressing force and a second pressing force smaller than the first pressing force with regard to a pressing force when the separation roller is pressed against the feeding roller by operating a switching lever provided on the apparatus main body portion and to detect a position of the switching lever, wherein only in a state in which the pressing force is the second pressing force in a state in which the apparatus main body portion is switched from the first reading posture to the second reading posture, the control section deploys the user interface configured for selection of the second feeding mode on the operation section.

11. A medium feeding method in a medium feeding apparatus configured to switch between a first feeding mode and a second feeding mode, comprising:

in the first feeding mode, when a first detection section positioned downstream of a feeding roller in a medium feeding direction detects passage of a trailing end of a preceding medium in a feeding standby state in which driving of the feeding roller that feeds the medium is stopped, starting the driving of the feeding roller to perform feeding of a succeeding medium, and in the second feeding mode, when a second detection section positioned downstream of the first detection section in the medium feeding direction detects the passage of the trailing end of the preceding medium in the feeding standby state, starting the driving of the feeding roller to perform the feeding of the succeeding medium.

* * * * *